US012263378B2

(12) United States Patent
Van Rens

(10) Patent No.: US 12,263,378 B2
(45) Date of Patent: Apr. 1, 2025

(54) CONTROLLING A FORCE GENERATOR OF AN EXERCISE APPARATUS

(71) Applicant: TRUEKINETIX B.V., Hillegom (NL)

(72) Inventor: Bas Jan Emile Van Rens, Hillegom (NL)

(73) Assignee: TRUEKINETIX B.V., Hillegom (NL)

( * ) Notice: Subject to any disclaimer, the term of this patent is extended or adjusted under 35 U.S.C. 154(b) by 220 days.

(21) Appl. No.: 17/906,862

(22) PCT Filed: Mar. 22, 2021

(86) PCT No.: PCT/EP2021/057322
§ 371 (c)(1),
(2) Date: Sep. 20, 2022

(87) PCT Pub. No.: WO2021/186083
PCT Pub. Date: Sep. 23, 2021

(65) Prior Publication Data

US 2023/0173342 A1 Jun. 8, 2023

(30) Foreign Application Priority Data

Mar. 20, 2020 (NL) ..... 2025185

(51) Int. Cl.
*A63B 24/00* (2006.01)
*A63B 22/06* (2006.01)

(52) U.S. Cl.
CPC ..... *A63B 24/0062* (2013.01); *A63B 22/0605* (2013.01); *A63B 2024/0093* (2013.01); *A63B 2220/16* (2013.01); *A63B 2220/51* (2013.01)

(58) Field of Classification Search
CPC .... A63B 2022/0611; A63B 2022/0617; A63B 2022/0623; A63B 2022/0629;
(Continued)

(56) References Cited

U.S. PATENT DOCUMENTS 7,833,135 B2 11/2010 Radow et al.
2009/0011907 A1* 1/2009 Radow ..... B62M 3/00 482/57
(Continued)

FOREIGN PATENT DOCUMENTS

WO 2007076068 A2 7/2007
WO 2007076068 A3 7/2007
(Continued)

OTHER PUBLICATIONS

Partial International Search Report and Provisional Opinion for corresponding International application No. PCT/EP2021/057322; dated May 19, 2021 (16 pages).
(Continued)

*Primary Examiner* — Zachary T Moore

(57) ABSTRACT

Methods and systems for controlling a force generator of an exercise apparatus are described wherein the method comprises determining or receiving angular positions of a rotatable axle of an exercise apparatus when a force is applied to a force receiving structure of the exercise apparatus, the rotatable axle being part of a mechanical power transmission system connecting the force receiving structure via the rotatable axis to a force generator which is controlled by a computer based on a kinematic model, the kinetic model representing equations of motion of the exercise the apparatus; determining or retrieving first geometrical scaling values associated with the angular positions and incorporating the first geometrical scaling values into the kinematic model to form a first modified kinematic model, the first geometrical scaling values being associated with a non-circular gear of a first predetermined non-circular geometry; and, determining applied force values for the angular positions, each applied force value representing a force that is applied to the force receiving structure; and, controlling the force generator based on first resistive force values to mimic
(Continued)

an exercise apparatus comprising a mechanical power transmission system including the first non-circular gear, the first resistive force values being computed using the first modified kinematic model and the applied force values.

20 Claims, 13 Drawing Sheets

(58) Field of Classification Search
CPC ..... A63B 2022/0635; A63B 2022/067; A63B 2022/0676; A63B 2022/0682; A63B 2022/0688; A63B 24/0062; A63B 2220/16
See application file for complete search history.

(56) References Cited

U.S. PATENT DOCUMENTS

2009/0298649 A1* 12/2009 Dyer ..... A63B 24/0003 482/4
2010/0248899 A1* 9/2010 Bedell ..... A63B 22/001 482/4
2010/0248905 A1* 9/2010 Lu ..... A63B 22/0605 482/57
2013/0245511 A1* 9/2013 Pidcoe ..... A61H 1/001 601/33
2015/0343262 A1* 12/2015 Su ..... A63B 22/203 482/8
2022/0003618 A1* 1/2022 Van Rens ..... A63B 21/0051
2023/0173342 A1* 6/2023 Van Rens ..... A63B 21/4043 482/5

FOREIGN PATENT DOCUMENTS

WO 2010005286 A1 1/2010
WO 2020071913 A1 4/2020

OTHER PUBLICATIONS

International Search Report and Written Opinion for corresponding International application No. PCT/EP2021/057322; dated Nov. 10, 2021 (22 pages).

* cited by examiner

CONTROLLING A FORCE GENERATOR OF AN EXERCISE APPARATUS

FIELD OF THE INVENTION

The invention relates to controlling a force generator of an exercise apparatus, and, in particular, though not exclusively, to methods and systems for controlling an exercise apparatus, a computer-controlled exercise apparatus and a computer program product for executing such methods.

BACKGROUND OF THE INVENTION

Modern exercise equipment tries to mimic reality using a force-feedback system, wherein some form of force is generated to counter the motion of the athlete based on his current state. The current state of the athlete may be measured by sensors in terms of speed and force, e.g. a torque in case of rotational forces. Based on the sensor information, a resistive force that the apparatus should provide is calculated by a computer and used to control an apparatus that is capable of generating a variable resistive force using mechanical, electrical and/or magnetic means.

U.S. Pat. No. 7,833,135 describes an example of a spinning bike, including a computer-controlled force generating device which generates a resistive (braking) force based on a measured velocity (using an encoder coupled to the crank) and a measured force (e.g. using a force sensor). Based on a simple equation of motion model (referred to as a kinetic model) the spinning bike can be modelled, wherein a computer may determine a computed velocity and compare the computed velocity with a measured velocity and control the generation of the resistive force on the basis of the difference between the calculated and the measured velocity.

Stationary exercise bicycles as described above, but also running mills, rowing machines and elliptical machines are examples of exercise equipment which include a power transmission system based on a circular gearing wherein a force exerted by an athlete on the exercise apparatus is counteracted by a variable resistive force. The force of the athlete creates a motion which counteracted by a resistance force generating unit based on friction (wind, rubbing, water), electro-magnetic coupling (e.g. based on eddy currents and/or an electrical motor) and/or weights. These resistance force generating units do a poor job mimicking the forces that the athlete experiences when performing the sport for real and thus provide a relatively poor user experience.

For example, for a rowing machine the angle of the oar to the boat as well as the weight of the boat and athlete(s) has a large influence on the propelling force and speed during a stroke of the athlete. Another example is an exercise bike which uses a chain or belt drive comprising a circular chain wheel even though non-circular or oval (elliptical) chain wheels are becoming more and more prevalent in real life cycling. Consequently, currently, a workout on a real (outdoor) sports apparatus is not equivalent to a workout on a conventional (indoor) stationary exercise device that simulates the (outdoor) sports apparatus.

The user experience and/or training effectiveness may be improved based on a power transmission system that is based on non-circular gearing. For example, in cycling, an elliptical chain wheel with prescribed varying diameters around its circumference may be used. Similarly, weight lifting machines and some rowing machines may use non-circular gears for mechanically simulating the various forces of a real-life exercise. Such non-circular gearings may be optimal for one particular sport situation, one type of equipment and one athlete. However, beside the fact that a mechanical non-circular gearing is complex and expensive, such gearings are difficult to optimize such non-circular gearings for different types of sports, different types of athletes and different types of equipment.

A rowing machine for example may have a fixed non-circular gearing to simulate the varying forces over the stroke. The mechanically simulated force curve will be optimized for a rower with a given weight in a boat with a given weight and a predetermined oar length, oar angle and foot position. However, on a conventional exercise apparatus the resistive force produced by the apparatus will not change if e.g. the oar length or the seat position is changed. Similarly, providing a bicycle with a non-circular chain ring, may mimic the setup that is optimal for only one person or one category of persons, while for other people the setup is non-optimal. Moreover, in weightlifting the non-circular gearing may vary with (or depend on) the physical dimensions of the person using the apparatus to truly provide an optimal exercise.

Controlled adjustment the resistive force requires changes or adjustments of the mechanical parts of the exercise equipment. However, testing different force curves of a fitness device by changing, e.g. the shape of a non-circular chain ring on a bike, is slow and cumbersome process. Non-circular gears are difficult to manufacture and expensive to incorporate in exercise equipment since additional components are needed to absorb the slack that will always occur in chains, cables when the effective radius of the gear reduces during the rotation. Implementation of mechanical non-linear gearing typically requires complex mechanical constructions. For example, WO2010/005286 describes a so-called power plate bike, i.e. a spinning bike which provides a vibrating effect to increase the training effectiveness, which includes a mechanical mechanism to achieve the effect of vibration. Such mechanical mechanism is however very complex and not suitable for allowing many different force effects.

Hence, from the above it follows that there is a need in the art for improved methods and systems that enable generation of non-linear forces for an exercise apparatus. In particular, there is a need in the art for non-linear force generating devices that enable generation of resistive forces for an exercise apparatus, wherein the resistive force produced by the exercise provides an accurate model of a real-life sports device and wherein the resistive force may be efficiently adjusted based on parameters of the athlete and/or training situation.

SUMMARY OF THE INVENTION

Aspects of the present invention are described below with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor, in particular a microprocessor or central processing unit (CPU), of a general purpose computer, special purpose computer, or other programmable data processing apparatus to produce a machine, such that the instructions, which execute via the processor of the computer, other programmable data processing apparatus, or other devices create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks. Additionally, the Instructions may be executed by any type of processors, including but not limited to one or more digital signal processors (DSPs), general purpose microprocessors, application specific integrated circuits (ASICs), field programmable logic arrays (FP-GAs), or other equivalent integrated or discrete logic circuitry.

The flowchart and block diagrams in the figures illustrate the architecture, functionality, and operation of possible implementations of systems, methods and computer program products according to various embodiments of the present invention. In this regard, each block in the flowchart or block diagrams may represent a module, segment, or portion of code, which comprises one or more executable instructions for implementing the specified logical function(s). It should also be noted that, in some alternative implementations, the functions noted in the blocks may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustrations, and combinations of blocks in the block diagrams and/or flowchart illustrations, can be implemented by special purpose hardware-based systems that perform the specified functions or acts, or combinations of special purpose hardware and computer instructions.

In a first aspect, the invention may relate to a method of controlling a force generator of an exercise apparatus.

In an embodiment, the method may comprise: determining or receiving angular positions of a rotatable axle of an exercise apparatus when a force is applied to a force receiving structure of the exercise apparatus, the rotatable axle connecting the force receiving structure to a force generator which is controlled by a computer based on a kinematic model, the kinetic model representing equations of motion of the exercise the apparatus; determining or retrieving first geometrical scaling values associated with the angular positions and incorporating the first geometrical scaling values into the kinematic model to form a first modified kinematic model, the first geometrical scaling values being associated with a non-circular gear of a first predetermined non-circular geometry; and, determining applied force values for the angular positions, each applied force value representing a force that is applied to the force receiving structure; and, controlling the force generator based on first resistive force values to mimic an exercise apparatus comprising a mechanical power transmission system including the first non-circular gear, the first resistive force values being computed using the first modified kinematic model and the applied force values.

Hence, the invention allows a computer to determine geometrical scaling values associated with a non-circular gear. These geometrical scaling values are used by the computer to control the force generator of an exercise apparatus. The geometrical scaling values are used by the computer to mimic an exercise apparatus comprising a mechanical power transmission system including the non-circular gear, for example an exercise bike comprising an elliptical chainwheel. The angular-dependent scaling factors allows the cross-sectional shape of a physical rotatable element of the mechanical transmission system of the exercise apparatus, e.g. a chainwheel or an axle, to be effectively transformed (deformed) into a non-circular shape. The angular-dependent scaling factors thus provide a controllable topological deformation of the shape of the rotatable element of the mechanical transmission system, which can be easily incorporated into the kinetic model of the exercise apparatus. Further, linking the angular-dependent scaling factors to a geometry allows easy visualization of the simulated non-circular gear. The geometrical scaling values $s(\alpha)$ define a geometry of the non-circular gearing which can be determined in advance for different geometries. This way, a simple computer model may be used to turn an exercise apparatus, e.g. an exercise apparatus that is based on a conventional circular gearing, into an exercise apparatus comprising a non-circular gearing. Moreover, it allows a user to select a particular geometry that is particularly adapted or optimized for a certain use and/or a certain person.

In an embodiment, the rotatable axle may be connected to the force receiving structure based on a mechanical power transmission system In an embodiment, the mechanical power transmission system may comprise a circular chain wheel rotatable connecting the force receiving structure via the axle to the force generator using a chain or a belt.

In an embodiment, at least part of the first geometrical scaling values may be determined based on a relative position of a first contact point between the chain or belt and the at least one non-circular gear as a function of the rotary positions $\alpha$. The position of the first contact point may be defined in terms of one or more geometrical parameters that are related to the geometry of the non-linear chainwheel. The geometrical parameters may include parameters for defining the outer shape of a chain wheel. For example, in case of an elliptical chain wheel parameters may include a center, two focal points, a semi-major axis (the length between the center and the long axis of the ellipse and/or a semi-minor axis (the length between the center and the short axis of the ellipse).

Additionally and/or alternatively, the geometrical parameters include one or more of: a first contact angle $\beta$ defining an angle between the y-axis, a line that runs through the center of the axis of the crankset and the first contact point, a second contact angle $\gamma$ defining an angle between the x-axis and a line that runs through the first contact point and a second contact point defining the contact point between the chain and a chainwheel that is connected to the axis of the force generator, e.g. an electromotor. Based on these geometrical parameters, geometric scaling factors that are dependent on the angular position of the axle of the exercise apparatus may be defined, which allows simple implementation of non-circular gears in the kinetic model.

Linking the scaling factors to a geometrical shape of a gear allows simple adjustment of the kinetic model using e.g. a graphical user interface that is connected to the computer that controls the force generator. This way, a user can interact with the GUI and select or adjust the geometry of the non-circular gear to a desired geometry.

In an embodiment, the first geometrical scaling values may be determined based on a geometrical scaling function or the first geometrical scaling values may be retrieved by accessing a look-up table. In an embodiment, the look-up table may comprise angular positions and/or associated geometrical scaling values.

In an embodiment, the first geometrical scaling values may define a geometry of a non-circular wheel. Shapes of the non-circular gear include any shaped that deviates from a pure circular shape including but not limited to elliptical shapes, oval shapes, triangular shapes (e.g. a Reuleaux triangle shape), square shaped or other polygonal shaped gears, These shaped gears may provide optimal power transmission for a particular user or situation. In other embodiments, the shape may be irregular, e.g. an irregular polygon shape.

In an embodiment, the first geometrical scaling values may transform an exercise apparatus with a circular gearing having a constant gearing ratio for different angular positions into an exercise apparatus with a virtual non-circular gear having different gearing ratio's for different angular positions.

In an embodiment, the mechanical force transmission system may comprise a band, a belt or a chain for connecting a first circular wheel of the mechanical force transmission system to a second circular wheel of the mechanical force transmission system, the first wheel being connected to the force generator and the second wheel being connected to a shaft of the force receiving structure, In an embodiment, determining angular positions of a circular gearing may include: receiving position information associated with angular positions of the circular gear.

In an embodiment, determining for a least part of the angular positions applied force values may include: receiving information about a deformation of at least part of the mechanical power transmission system during the application of a force to the force receiving structure, preferably receiving information about an angular displacement $\Delta\theta$ of a rotatable shaft to which the force receiving structure and the force generator are connected; and, determining the applied force values based on the deformation.

In an embodiment, the method may further comprise: receiving a trigger for changing from the first geometry to a second geometry, preferably the trigger being generated by a user interface connected to the computer; in response to the trigger, determining or retrieving second geometrical scaling values associated with the angular positions and incorporating the second geometrical scaling values into the kinematic model of the exercise apparatus, the second geometrical scaling values being associated with a second non-circular gear of a second geometry and computing second resistive force values based on the kinematic model and the applied force values; controlling the force generator based on the second resistive force values, the controlling including the force generator using the second resistive force values to generate a resistive force to mimic an exercise apparatus comprising a mechanical power transmission system including the second non-circular gear. Hence, the shape of the non-circular (virtual) gearing may be modified while the user is using it. This way, the load on the athlete may be varied during an exercise.

In an embodiment, the shape of the non-circular gearing can be determined from exercise data from previous exercise moments of one or more athletes.

In an embodiment, the exercise apparatus may be a stationary exercise bicycle, wherein the mechanical power transmission system is a bicycle drivetrain and wherein the force receiving structure comprises a crankset connected to pedals.

In an embodiment, the exercise apparatus may be a stationary rowing machine or a weight lifting machine.

In an aspect, the invention may relate to a method of determining a geometry of non-circular gear for mechanical power transmission system of exercise apparatus. In an embodiment, the method may include one or more of the following steps: determining a cost function for the exercise apparatus; determining or selecting a geometrical scaling function associated with a geometry of a non-circular gear and a kinetic model of the exercise apparatus using the geometrical scaling function and a measured force applied to a force receiving structure of the exercise apparatus to control a force generator of the exercise apparatus; determining a loss value based on the cost function, the loss value being associated with a measured physical quantity of the exercise apparatus and adjusting the geometry of the non-circular gear and the associated geometrical scaling function if the first loss value does not comply with an optimization condition; repeating the determining of further loss values and further adjustments of the geometry of the non-circular gear and the associated geometrical scaling function until a loss value complies with the optimization condition.

Hence, the method allows optimization of the geometry of the non-circular gearing to increase the performance of the athlete. A data representation of the optimized geometry of the virtual non-circular gear may be stored in the memory of the exercise apparatus or on a storage medium in the network. Additionally and/or in addition, a data representation of the optimized geometry of the virtual non-circular gear may be used to manufacture a physical non-circular gear so that an athlete can use it in a read-life apparatus. For example, a data representation of a geometry of an elliptical chainwheel that is optimized for a specific athlete may be used by a 3D printer to produce a personalized elliptical chainwheel that can be mounted on a bicycle.

In a further aspect, the invention may relate to a method wherein an exercise apparatus in any of the above described embodiments is used to determine an optimal geometry of a non-circular gearing. A data format (model description) of the optimal geometry may be stored on a storage medium. Further, the data format may be used to convert the optimal geometry into one or more physical gears to be used in an exercise apparatus that is capable of using non-circular gears.

The embodiments thus may include a service wherein an exercise apparatus can be used to determine an optimal non-circular gearing geometry for a certain athlete for a certain load case and then providing the athlete with a data format of the virtual geometry of that non-circular gearing for continued use on the exercise bike and/or for the manufacturing of a physical copy of the optimized non-circular gear.

In an embodiment, the method may include generating a data structure representing the geometry of the non-circular gear that complies with the optimization condition.

In an embodiment, the method may include using the data structure to control a computer-controlled manufacturing system to manufacture a non-circular gear In a further embodiment, the cost function may be configured to minimize a peak force applied to the mechanical power transmission system or a peak angular velocity of a gear in the mechanical power transmission system.

In an embodiment, the cost function may be configured to minimize fluctuations in the force applied to the mechanical power transmission system or a fluctuations in the angular velocity of a gear in the mechanical power transmission system.

In an further aspect, the invention may relate to a controller for an exercise apparatus comprising: a computer readable storage medium having computer readable program code embodied therewith, and a processor, preferably a microprocessor, coupled to the computer readable storage medium, wherein responsive to executing the computer readable program code, the processor is configured to perform executable operations comprising: determining or receiving angular positions of a rotatable axle of an exercise apparatus when a force is applied to a force receiving structure of the exercise apparatus, the rotatable axle connecting the force receiving structure to a force generator which is controlled by a computer based on a kinematic model, the kinetic model representing equations of motion of the exercise the apparatus; determining or retrieving first geometrical scaling values associated with the angular positions and incorporating the first geometrical scaling values into the kinematic model to form a first modified kinematic model, the first geometrical scaling values being associated with a non-circular gear of a first predetermined non-circular geometry; and, determining applied force values for the angular positions, each applied force value representing a force that is applied to the force receiving structure; and, controlling the force generator based on first resistive force values to mimic an exercise apparatus comprising a mechanical power transmission system including the first non-circular gear, the first resistive force values being computed using the first modified kinematic model and the applied force values.

In a further aspect, the invention may relate to an exercise apparatus comprising: a frame; an axle rotatable mounted to the frame; a force receiving structure connected to the axle; a force generator connected to the axle; a computer system connected to the force generator; and, a computer readable storage medium having computer readable program code embodied therewith, and a processor, preferably a microprocessor, coupled to the computer readable storage medium, wherein responsive to executing the computer readable program code, the processor is configured to perform executable operations comprising: determining or receiving angular positions of a rotatable axle of an exercise apparatus when a force is applied to a force receiving structure of the exercise apparatus, the rotatable axle connecting the force receiving structure to a force generator which is controlled by a computer based on a kinematic model, the kinetic model representing equations of motion of the exercise the apparatus; determining or retrieving first geometrical scaling values associated with the angular positions and incorporating the first geometrical scaling values into the kinematic model to form a first modified kinematic model, the first geometrical scaling values being associated with a non-circular gear of a first predetermined non-circular geometry; and, determining applied force values for the angular positions, each applied force value representing a force that is applied to the force receiving structure; and, controlling the force generator based on first resistive force values to mimic an exercise apparatus comprising a mechanical power transmission system including the first non-circular gear, the first resistive force values being computed using the first modified kinematic model and the applied force values.

In yet a further aspect, the invention may relate to a method of controlling a force generator of an exercise apparatus, the method comprising: determining or receiving angular positions of an axle of the exercise apparatus when a force is applied to a force receiving structure of the exercise apparatus, the axle connecting the force receiving structure to a force generator which is controlled by a computer based on a kinematic model, the kinetic model representing equations of motion of the exercise the apparatus; determining or receiving gearing ratio values as a function of the angular positions, the gearing ratio values being associated with a geometry of a non-circular gearing and incorporating the gearing ratio values into the kinematic model to form a modified kinematic model; determining for each of the angular positions, an applied force value representing a force that is applied to the force receiving structure; and, providing the angular positions and the applied force values to the input of the modified kinetic model of the exercise apparatus; and, controlling the force generating device based on the gearing ratio values and applied force values to generate a resistive force to mimic the exercise apparatus comprising a mechanical power transmission system including the non-circular geometry.

In an aspect, the invention may relate to an exercise apparatus comprising: a frame; an axle rotatable mounted to the frame; at least one force receiving structure connected to the rotatable axle and a force generator connected to a second part of the rotational shaft; a position detection system configured to measure the angular position of the circular gearing of the mechanical power transmission system, the angular position being generated by the position detection system in response to a user of the exercise apparatus applying a force to the force receiving structure; and, a computer configured to control the force generator, the computer being configured to: determine or receive angular positions of an axle of the exercise apparatus when a force is applied to a force receiving structure of the exercise apparatus, the axle connecting the force receiving structure to a force generator which is controlled by a computer based on a kinematic model, the kinetic model representing equations of motion of the exercise the apparatus; determine or receive gearing ratio values as a function of the angular positions, the gearing ratio values being associated with a geometry of a non-circular gearing and incorporating the gearing ratio values into the kinematic model to form a modified kinematic model; determine for each of the angular positions, an applied force value representing a force that is applied to the force receiving structure; and, provide the angular positions and the applied force values to the input of the modified kinetic model of the exercise apparatus; and, control the force generating device based on the gearing ratio values and applied force values to generate a resistive force to mimic the exercise apparatus comprising a mechanical power transmission system including the non-circular geometry.

The invention may also include systems and controller that are configured to execute the above described methods.

The invention may also relate to a software program product comprising software code portions configured for, when run in the memory of a computer, executing the any of the method steps described above.

The invention will be further illustrated with reference to the attached drawings, which schematically will show embodiments according to the invention. It will be understood that the invention is not in any way restricted to these specific embodiments.

DETAILED DESCRIPTION

The embodiments described in this application aim to enable an exercise apparatus to behave as an exercise apparatus having a power transmission system based on a non-circular gearing. The embodiments include exercise apparatuses comprising a power transmission system including a rotatable axle, and a computer-controlled force generating unit that is controlled to generate a resistive force that models a power transmission system that comprises a non-circular gearing, e.g. a crankset comprising an elliptical or oval chain ring.

Conventional exercise apparatuses use a mechanical power transmission system that includes one or more rotating axels and gears to transfer a force applied on a force receiving structure to a resistive load that mimics the resistive force that an athlete experiences when using the exercise apparatus. For example, a rowing machine may comprise a mechanical power transmission system including a gear that transfers the linear motion of handle into a rotating motion of the flywheel and the brake. A stationary exercise bicycle may have a bicycle drivetrain system include multiple gears to speed up the rotation of the pedals into a rotation that can more effectively be countered by a brake.

In some cases however, an exercise apparatus may be equipped with a non-circular gearing. For example, weight-lifting devices may use non-round gears to vary the resistance throughout the range of motion to more realistically mimic the resistance an athlete feels when working with free weights against gravity. Similarly, some rowing machines use non-circular gearing structures to mimic the varying resistance that is felt by an athlete throughout the stroke. In outdoor cycling non-circular chain wheels such as elliptical or oval chain wheels are used because it is believed that such chain wheels allow improved performance of the athlete. These non-circular gearings however are very complex and cannot easily be adapted to change between non-circular gearings of different geometry. Adaption of the geometry of the non-circular gearing is particular important as for optimized training it is desired that the gearing can be optimized for each athlete individually.

Figure 1:
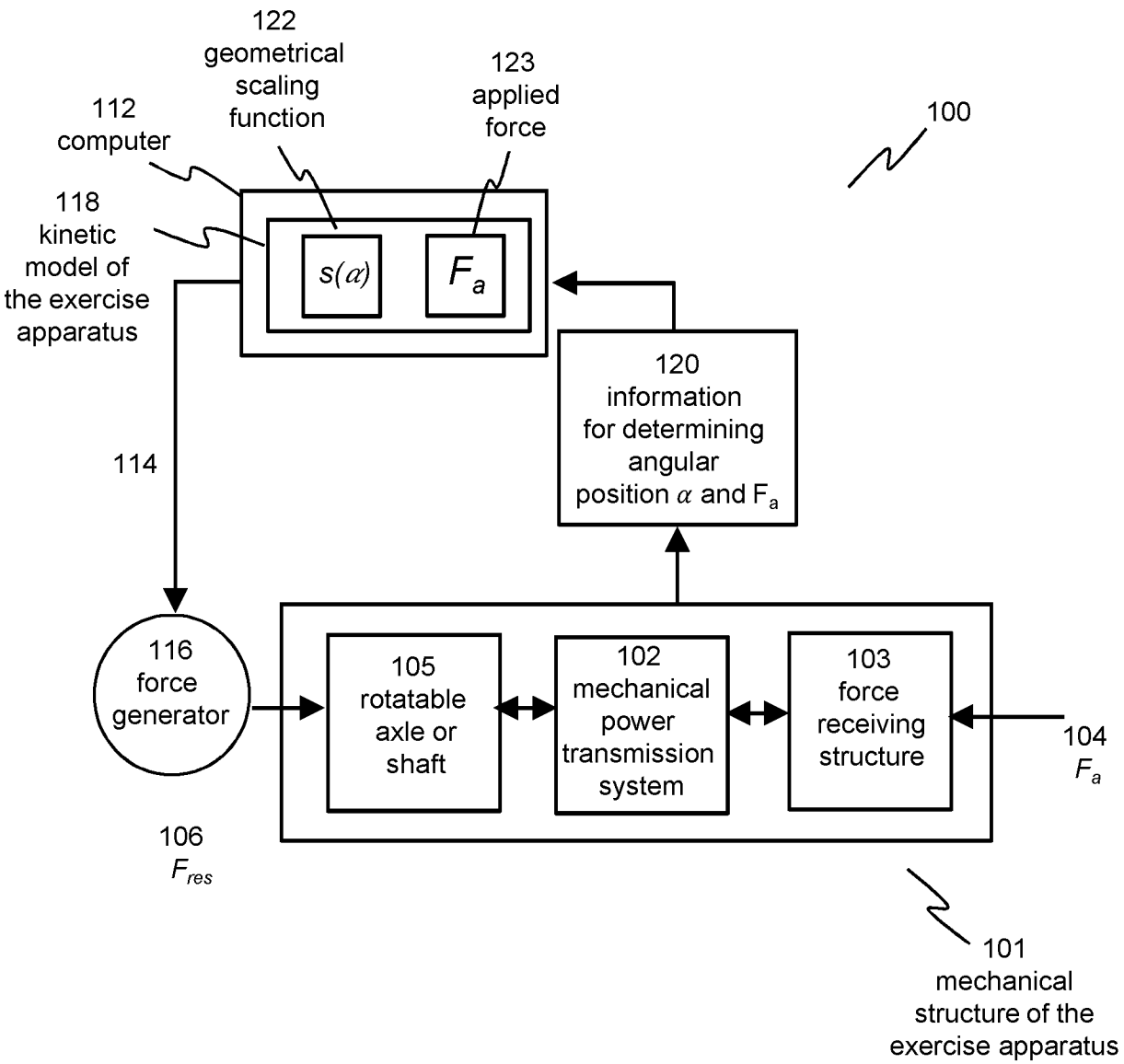
FIG. 1 depicts part of an exercise apparatus controlled by a computer-controlled force feedback system.

FIG. 1 depicts a schematic of a scheme for controlling a force generator of an exercise apparatus according to an embodiment of the invention. The exercise apparatus may include a mechanical structure 101 including a force receiving structure 103 connected to a rotatable axle or shaft 105. The axle or shaft is further connected to a computer-controlled force generator 116.

In some embodiments, the a mechanical power transmission system 102 may connect the force receiving structure to the rotatable axis or shaft. The mechanical power transmission system may comprise one or more circular gears which are rotatable connected to a computer-controlled force generator 116, for example an electromotor. Here, the term mechanical power transmission system refers to any mechanical system for transmitting power (or any associated quantity such as force or velocity) generated at one location to another location, e.g. from a first rotating shaft or axle to a second rotating shaft or axle. A mechanical power transmission system may comprise one or more mechanical power transmission elements such as shafts, gears, gear trains, belts, pulleys, chains, sprockets, etc. Examples of such mechanical power transmission systems include chain and belt transmission systems based on one or more circular gears, wherein a gear ratio depends on the radii of the circular gears.

When a force $F_a$ 104 is applied to the force receiving structure of the exercise apparatus, the user will experience a resistive force $F_{res}$ 106 which is generated by the force generator 116. The computer may include a kinetic model 118 of the exercise apparatus, e.g. in the form of a software program, that is configured to receive an input and to generate a control signal 114 for the force generator as an output. The kinetic model may be based on the equations of motions describing the behavior of the exercise apparatus and may further include external parameters relating to road conditions, e.g. wind and slope angle of the road in case of an exercise bike. This way, the kinetic model may accurately control the force generator to simulate certain exercise conditions, examples of such kinetic models are for example described in US2009/0011907 which may be incorporated by reference into this application. A sensor system 120 may be configured to measure information that allows to determine the force $F_a$ that the athlete applies to the apparatus and a computer 112 may use this information as an input to the kinetic model of the exercise apparatus to generate the control signal 114 for the force generator to generate a resistive force $F_{res}$ that opposes the force of the athlete so that $F_a \approx F_{res}$.

The mechanical power transmission system of the exercise apparatus may be based on a circular gearing. In such cases, one or more circular gear ratio's $E_c$ may be defined based on the radii of the circular gears. The computer may use the kinetic model to control the force generator to generate a resistive force $F_{res}$ which is increased or reduced according to the relation $F_a=E_c \cdot F_{res}$. Depending on the implementation of the exercise apparatus a number of different gearing ratio's may be defined, for example to mimic different gears for a bike.

In certain situations however, it is desired to model an exercise apparatus that is based on a power transmission system that has a non-circular gearing. Hence, in that case the computer has to control the force generator to produce a resistive force as if the exercise apparatus is equipped with a non-circular gear. In that case, an athlete using the exercise apparatus will experience a resistive force as if the exercise apparatus is equipped with a non-circular gearing. For example, in case of a stationary exercise bicycle, the computer may control the force generator to mimic an exercise apparatus that has an elliptical chain wheel.

To that end, the sensor system 120 may be configured to determine information about the angular position $\alpha$ of the circular gearing. Additionally, the sensor system may be configured to determine information about the force that is applied by the user to the force receiving structure. Preferably, the information enables the computer to determine a value for the force that is applied for each rotary position of the axle. For example, in an embodiment, the information may include an angular displacement $\Delta\theta$ of the rotatable axle to which the force receiving structure and the force generator are connected. The information generated by the sensor system may be fed to the input of the computer and force calculator module 123 may use the positional information, especially the angular displacement $\Delta\theta$ (the angle of twist) to calculate a force that is applied to the force receiving structure. Further, the position information, in particular the angular position $\alpha$, may be used to calculate geometrical scaling values based on a geometrical scaling function $s(\alpha)$ 122 for modelling the effect of a gearing that has a predetermined non-circular geometry, e.g. an elliptical geometry. The geometrical scaling function may be implemented in various ways, including but not limited to an analytical function or a look up table including geometrical scaling values for different angular positions. Based on the geometrical scaling values and the determined applied force, the computer may control the force generator to generate a resistive force wherein the relation between the resistive force and the applied force may depend on a gear ratio $E(\alpha)$, which now depends on the angular position: $F_a=E(\alpha)\cdot F_{res}$.

Thus, when such exercise apparatus is used, position information associated with the axle of the exercise apparatus is detected and fed to the input an algorithm representing the kinetic model of the exercise apparatus which may for example be implemented as a software program. This way, the kinetic model that includes the geometrical scaling function describes the behavior of an exercise apparatus that has a power-transmission system based on a non-circular gearing. In particular, based on the position information, the computer may use the algorithm to generate a control signal for the force generator to produce for each angular position of the circular gear of the exercise apparatus a resistive force $F_{res}$ representing the effect of the non-circular gearing. Here, the algorithm may take into account that the real-life exercise apparatus may have one or more circular gears associated with one or more constant gearing ratio's E and that the effect of a non-round gearing can be described by the geometrical scaling function $s(\alpha)$, which depends on the angular position.

In that case, the relation between the applied force and the resistive force may be expressed in terms of the gear ratio of the circular gearing of the exercise apparatus and an angular position dependent geometrical scaling function $F_a=E(\alpha)\cdot F_{res}=E\cdot(F_{res}/s(\alpha))$. Thus, the resistive force $F_{res}$ which the athlete experiences may be described by an effective gear ratio $E'(\alpha)=E_c/s(\alpha)$, wherein $E_c$ defines a circular gear ratio associated with a circular gearing of the exercise apparatus and $s(\alpha)$ the angular position depended geometrical scaling factor. The algorithm may use the effective gearing factor $E'(\alpha)$ to mimic an exercise apparatus being equipped with a non-circular gearing. The geometrical scaling function $s(\alpha)$ may be simply defined as a function of the angular position of the round gear. Inventors discovered that a realistic simulation of a non-round gearing system can be achieved by using a geometrical scaling function which depends on the angular position and the geometry of the non-round gear. Examples of such embodiments are described hereunder in more detail.

Figure 2:
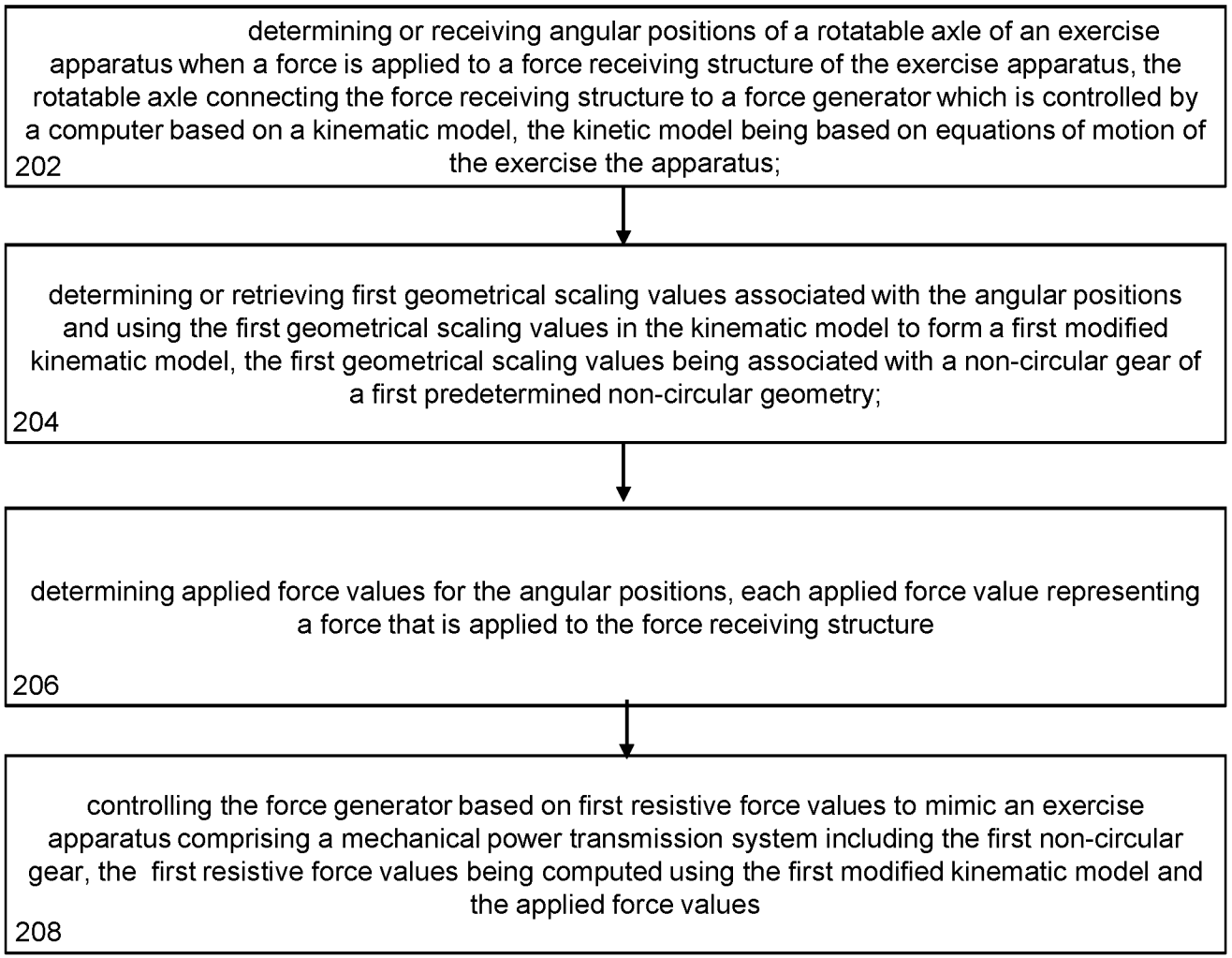
FIG. 2 depicts a method of controlling a force generator of an exercise apparatus according to an embodiment of the invention.

FIG. 2 depicts a method of controlling a force generator of an exercise apparatus according to an embodiment of the invention. In particular, the figures depicts a method of controlling a force generator of an exercise apparatus as for example described with reference to FIG. 1. As shown in the figure, the method may include a step of determining angular positions of an axle of an exercise apparatus when a force is applied to a force receiving structure of the exercise apparatus. (step 202). Here, the axle may be part of a mechanical power transmission system connecting the force receiving structure to a force generator which is controlled by a computer based on a kinematic model of the exercise apparatus as described above with reference to FIG. 1.

The computer may further determine or retrieve first geometrical scaling values associated with the angular positions and incorporate the first geometrical scaling values into the kinematic model of the exercise apparatus thus forming a modified kinetic model associated with a first non-circular gear of a first geometry (step 204). Hence, the angular position dependent geometrical scaling values may represent a virtual non-circular gearing of a desired geometry.

Applied force values for the angular positions may be determined, wherein each applied force value may represent a force that is applied to the force receiving structure. Further, first resistive force values may be computed based on the modified kinematic model and the applied force values (step 206). Here, a resistive force value may represent a force to be generated by the force generator in response to an applied force value at a certain angular position of the circular gear.

The computer may control the force generator based on the resistive force values, wherein the controlling may include the force generator using the resistive force values to generate a resistive force to mimic an exercise apparatus comprising a mechanical power transmission system including the first non-circular gear (step 208).

Hence, the method allows a computer to determine an effective gear ratio for each angular position of a circular gear of an exercise apparatus. This effective gear ratio provides the relation between a resistive force generated by the force generator and a force applied by the user of the exercise apparatus to the force receiving structure for each angular position of the axle. The effective gear ratio $E'(\alpha)$ may be used by the computer to control the force generator to mimic an exercise apparatus comprising a power transmission system that is based on a non-circular gearing. As will be shown in more detail below, the geometric scaling function $s(\alpha)$ may be determined based on the geometry of the non-circular gearing and thus can be determined in advance for different geometries. This way, a simple computer model may be used to turn an exercise apparatus that is based on a conventional circular gearing into an exercise apparatus comprising a non-circular gearing.

Figure 3:
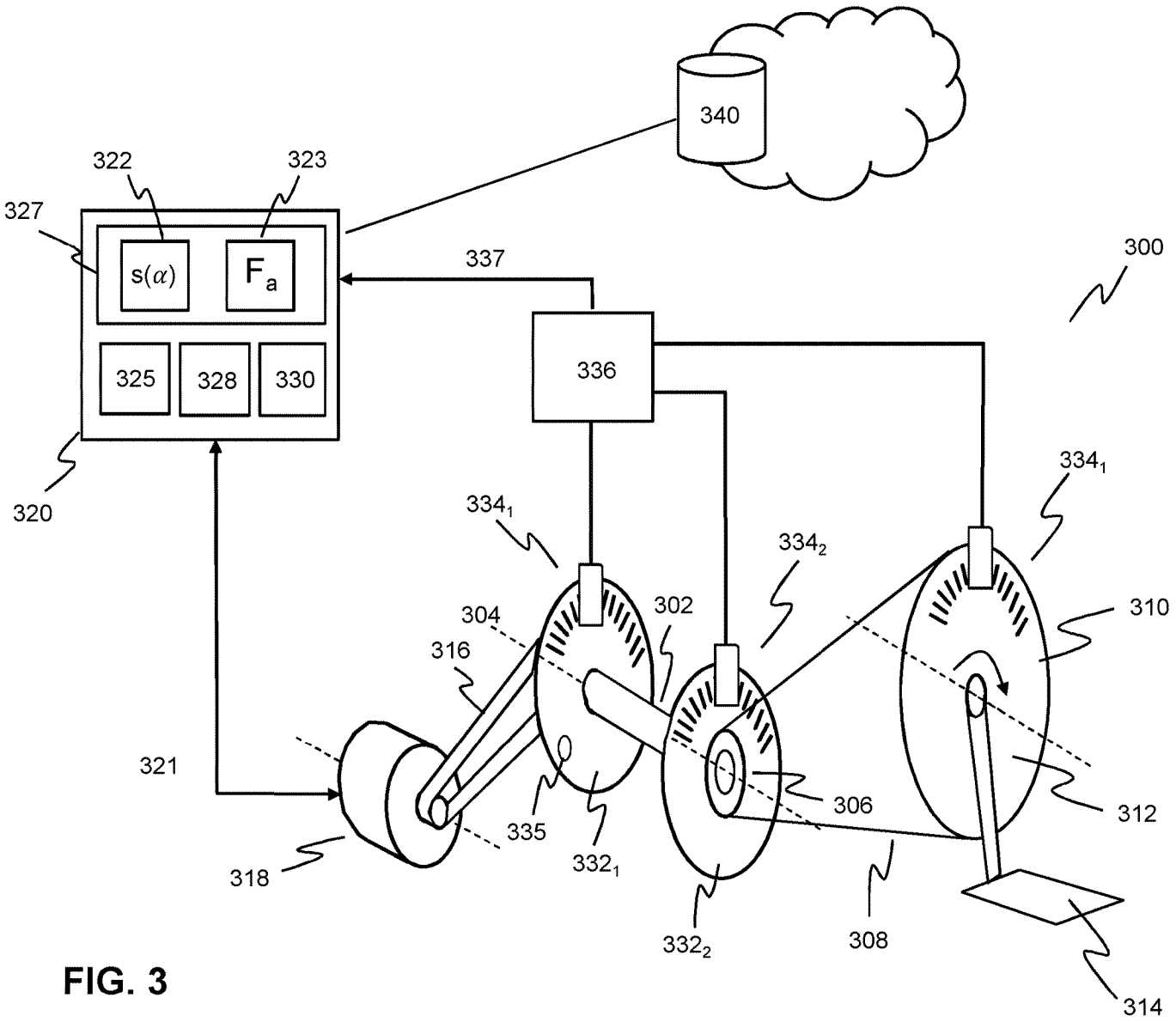
FIG. 3 depicts part of an exercise apparatus according to an embodiment of the invention.

FIG. 3 depicts part of an exercise apparatus according to an embodiment of the invention. As shown in the figure, the exercise apparatus 300 may include a rotatable shaft 302 connected via a mechanical power transmission system (e.g. a drivetrain system of a bicycle) to a force receiving structure (e.g. pedals connected to the crank set) and connected to a computer-controlled force generator. Similar to the exercise apparatus of FIG. 1, a computer 320 may be configured to receive information 337 about the angular position $\alpha$ of the circular gearing and the force $F_a$ 323 that is applied to the force receiving structure and uses this information as input to a kinetic model 327 to control a force generator 318 wherein the kinetic model may include a geometrical scaling function $s(\alpha)$ associated with a geometry of a non-circular gearing, e.g. a non-linear chainwheel. The geometrical scaling function is dependent on the angular position $\alpha$ so that the exercise apparatus behaves as if it is equipped with a mechanical power transmission system having a gear of a non-circular geometry.

The computer may include a user interface UI 325 allowing a user to select a particular geometry of the chainwheel, e.g. circular or non-circular, that needs to be mimicked based on the kinetic model. For example, in an embodiment, the UI may be a graphical user interface allowing a user to set a geometry of the chainwheel based on e.g. a number of parameters (e.g. the parameters defining an elliptical shape). In another embodiment, the UI may be configured as a graphical user interface including a touch screen. The GUI may render a chainwheel of a particular geometry and the GUI may be configured such that the user may interact with the rendered chainwheel to change the shape and/or dimensions of the chainwheel. The computer may also include a communications interface 330, e.g. a wired and/or a wireless interface for connecting the computer to a server 340 in the network. In an embodiment, the computer may include an optimization module 330 that is configured to optimize a geometry of the chainwheel according to certain optimization rules. For example, a cost function may be used which may be used to optimize the geometry of the chainwheel for an athlete. The optimization module is described hereunder in more detail with reference to FIG. 13.

The computer system and the module executed by the computer system for controlling the force generator of the exercise apparatus as depicted in FIG. 3 may be implemented in various ways. For example, instead of the computer of the excursive apparatus executing the various modules, including the kinetic model and the optimization module, these modules may also be executed in the network, e.g. as a cloud application.

The shaft may comprise two parts to which opposing torques (opposing forces) can be applied. The resulting torque applied to the shaft may cause to shaft to rotate around its longitudinal axis 304. The rotatable shaft 302 may be part of a mechanical or electro-mechanical exercise apparatus, e.g. a stationary exercise bicycle or a rowing apparatus. In an embodiment, the shaft may be part of an axis, e.g. a rear axis, of a spinning bike, wherein the shaft may be rotatable mounted in a stationary frame (not shown) of the exercise apparatus such that the shaft can rotate around its longitudinal axis.

The rotatable shaft 302 may include a first part (e.g. a first end) configured to receive a first torque and second part (e.g. a second end) configured to receive a second torque. To that end, the first part may be connected to a force receiving structure, i.e. a structure for receiving an external force. The force receiving structure may be connected via a mechanical power transmission system to the rotatable shaft, wherein the mechanical power transmission system is based on a circular gearing. The figure shows an example of a stationary exercise bicycle, wherein the circular gearing is implemented as a conventional bicycle drivetrain system.

The drivetrain system may include a circular (chain)wheel 310 that is mounted to a rotatable crank and a circular rear gear 306 connected to the first part of the shaft so that the shaft is rotatable connected via a chain or a belt 308 to the (chain)wheel. The crank may include crank arms to which pedals 314 are attached. When applying a force $F_a$ to the force receiving structure, e.g. the crank and the pedals, a first torque may be applied to the shaft which may cause the shaft to rotate. The second part of the shaft may be configured to receive a resistive force $F_{res}$, e.g. a braking force, of a force generator 318. A force generator may include any type of means for generating a force, including but not limited to a braking force mechanism based on a mechanical brake, an eddy current brake, a viscous brake, an alternator brake, etc. The generator may be controlled by a computer 320 in order to controllably apply a torque of a predetermined value to the second part of the shaft.

For example, in FIG. 3 a force generating device may be implemented as an alternator which is rotatable connected via e.g. driving band 316 to the second part of the shaft. The force generating device may be controlled by the computer 320 to exert a resistance force or brake force on the second part, which may create a second torque which is opposite to the first torque created by e.g. an external force such as pedal forces, wherein the relation between the applied force $F_a$ and the resistive force $F_{res}$ is given by a constant gear ratio $E_c$, wherein the gear ratio depends on the dimensions of the rear gear and the chainwheel.

An encoder system 336 may be configured to determine position information for determining the angular position of the circular gearing. For example, the encoder system may include one or more readout structures $\mathbf{334}_{1\text{-}3}$ connected to one or more rotating parts of the power transmission system respectively. A readout structure may comprise a plurality of angular position indicators e.g. slots, which can be readout using a readout device, e.g. an optical or electromagnetic sensor. Each of the position indicators may have predetermined dimensions and/or shapes. The position indicators may be provided along a circular path on the disc, e.g. a circular path at the periphery of the disc.

A first readout structure $\mathbf{334}_1$ may be connected to a first part of the shaft, a second readout structure $\mathbf{334}_2$ may be connected to a second part of the shaft. In some embodiments a third readout structure $\mathbf{330}_3$ may be connected to the chainring. The encoder system may collect position information by reading out one or more of the readout structures. Further, the encoder system may use position information of at least two readout structures to determine a relative angular displacement also referred to as the angle of twist $\Delta\theta=\theta_1-\theta_2$, wherein $\theta_1$ is the angular position measured by a first readout structure and $\theta_2$ is the angular position measured by the second readout structure. In other embodiment, the angular position of the first or second readout structure and the angular position of the third readout structure may be used to determine the angle of twist. It is submitted that the configuration of the readout structures as illustrated in FIG. 3 is just a non-limiting example to measure position information allowing to determine the angular position of the circular gearing and the force that is applied to the force receiving structure of the exercise apparatus.

In an embodiment, the shaft may include an elastically deformable part (not shown), e.g. a spring structure, that has a predetermined spring behavior. In particular, part of the shaft may include an elastic spring part that exhibits a reversible torsional elastic deformation that is approximately linear with the torque that is applied to the shaft. The spring structure may be implemented in various ways. For example, the spring structure may include an elastomeric material or a mechanical spring, etc. enabling relative rotary displacement of the two parts of the shaft when a torque is exerted on the shaft. Based on the readout of the first and second readout structures the angle of twist represents a measure of the torque applied to the spring structure, and thus to the shaft of the torque sensing system. The spring structure may have any suitable form as long as it is capable of providing linear correlation between the torques applied to the shaft and the angle of twist. The spring structure may comprise one or more mechanical rotary springs, compression springs and/or one or more (visco)elastic springs The encoder system may be implemented in different ways, e.g. in an embodiment, the encoder system may include one or more optical encoders, wherein the readout structure may include a plurality of position indicators in the form of one or more slots, e.g. windows. A readout device may include an optical source and at least one optoelectronic detector. In another embodiment, the encoders may be magnetic encoders, wherein the readout structure may include a plurality of position indicators in the form of magnetic elements. Further, the readout device may include at least one magnetic head.

In an embodiment, the readout structure may include a reference element, e.g. a window or a magnetic element, that has dimensions or physical properties (e.g. magnetic field strength) that are different from the regular position indicators.

In a further embodiment, the readout device may comprise one or more camera's. In that case, one or more position indicators may be associated with a code, e.g. a barcode or a QR code representing a unique (sequence) number, which may be used to link a position indicator to a position. For example, in an embodiment, the position indicators may be configured as coded slots which may be read out optically or magnetically. The position indicators are coded such that each position indicator can be associated with a different code which in turn may be related to an absolute rotary position, using e.g. a lookup table or a mathematical function. The coding one or more position indicators enable the computer to determine a rotary position for each position indicator of the readout structure. Coding can be based on one indicator (e.g. a reference indicator) indicating the absolute position of one position indicator which may be used to derive the absolute positions of the other position indicators. Alternatively, a plurality of position indicators may be coded so that each of the position indicators can be directly linked to a position.

Thus, the encoder system 336 may be configured to generate position information which is used by the computer to compute angular position $\alpha$ and an applied force. For example, as described above, the position information may include angular displacement $\Delta\theta$ which can be used to calculate the applied force $F_a$ based on the spring constant of (part of) the power transmission system as a function of the angular positions. Further, for each angular position of the circular gear, the computer may also determine a geometrical scaling value as described above with reference to FIG. 1. Based on the determined applied force, the computer may use a kinetic model to control the force generator to generate a resistive force. As the geometrical scaling function is incorporated in the kinetic model, the relation between the resistive force and the applied force will depend on the effective gear ratio, which provides the effect of the non-round gearing.

The kinetic model may be implemented as an algorithm that controls the force generator (and therefore the resistive force experienced by the user of the exercise apparatus) based on the equations of motions in which the geometrical scaling function is incorporated. For example, in case of an exercise bicycle, a simple model based on the equation of motion may be used to describe the behavior of the exercise apparatus:

$$m \cdot \frac{dv}{dt} = F_{prop} - F_{res} \tag{1}$$

wherein m represent the mass of the system (the combined mass of the bicycle and the athlete), v represents the angular speed of the wheels of the bicycle, $F_{prop}$ represents the propulsion force that forces a bicycle to move and $F_{res}$ represents a resistive force experienced by the moving bicycle. Any suitable model may be used including more advanced models that include other parameters such as the flexibility of the frame and/or chain or belt into account as well.

The propulsion force can be expressed in terms of, amongst others, a force $F_{pedal}$ on the pedals of the bicycle, the gear ratio associated with the drivetrain of the bicycle and a ratio between length $L_{crank}$ of the crank and the radius of the rear wheel $R_{wheel}$. Here, the gear ratio may be a gear ratio of a circular gearing $E_c$, obtained by dividing the number of teeth on the front wheel by the number on the rear sprocket. In case of bicycle with different gears, a number of different circular gear ratio's may be used. Similarly, the resistive force $F_{res}$ that works against the propulsion force, includes, amongst others, a force due to a slope angle of the road, a force due to the wind and a force due to the rolling resistance:

$$F_{res}=F_{climb}+F_{wind}+F_{roll} \tag{2a}$$

$$F_{prop}=F_{pedal}\cdot(L_{crank}/R_{wheel}/E_c \tag{2b}$$

Given these equations of motions, a counter-acting pedal force, which counter acts the force applied by the athlete may be computed in many ways depending on the implementation. In case of an exercise bicycle that is connected to a computer-controlled force generator, e.g. an electromagnetic motor, as depicted in FIG. 3, the counter-acting pedal force may be computed in terms of an angular motor speed $v_c$ which defines the angular speed of the bicycle.

As already described above with reference to FIGS. 1 and 2, a non-circular gearing can be modelled based on an effective factor $E(\alpha)$, which is dependent on the angular position of the circular gearing. Thus, to mimic the effect of a non-circular gearing on an exercise apparatus that is equipped with a circular gearing, the computer may use a model an effective gear ratio $E'(\alpha)=E_c/s(\alpha)$ needs to be used wherein the geometrical scaling function $s(\alpha)$ provides the effect of the non-circular gearing. This way, an effective propulsion force $F_{prop}'$ may be defined based on geometrical scaling function $s(\alpha)$ in the following way:

$$F_{prop}'=(1/s(\alpha))\cdot F_{pedal}\cdot(L_{crank}/R_{wheel})/E_c \tag{3}$$

This modified propulsion force may be used to calculate a modified angular velocity v' taking into account that the real (measured) angular velocity v has to account for power equilibrium P:

$$P=F_{prop}\cdot v=F_{prop}'\cdot V' \quad (4)$$

Based on equations (1)-(3), the modified propulsion force can be defined in terms of the propulsion force $F_{prop}$ and the geometrical scaling function s(α):

$$F_{prop}'=F_{prop}\cdot(1/s(\alpha)) \quad (5)$$

This equation can be substituted in equation (4) to construct an expression of the power P in terms of the modified angular velocity v':

$$P=F_{prop}\cdot(1/s(\alpha))\cdot v' \quad (6)$$

Combining this expression with equation 4 allows the modified angular speed v', i.e. the speeds that needs to be generated by the force generator, to be written in terms of the measured angular speed and the geometrical scaling factor s(α):

$$v'=v\cdot s(\alpha) \quad (7)$$

Thus, as shown by equation (5), the effect of the force of the athlete on the exercise apparatus needs to be scaled with the geometrical scaling function 1/s(α) to account for the non-circular gearing in the chain of motion. At the same time, the change in angular position v' that is the result of this scaled force needs to be scaled with s(α) as illustrated by equation (7). In essence, the geometrical scaling function s(α), which defines geometrical scaling values for different rotary positions α, may be used to transform a non-circular chainwheel of a certain non-circular shape to a circular chain wheel or vice-versa. For example, in a very crude approximation, the effect of a non-circular chainwheel on a circular chainwheel may be obtained by dividing the radius of the circular chainwheel by geometrical scaling values s(α) for different angular positions α of the chainwheel. This is illustrated in more detail below.

Figure 4:
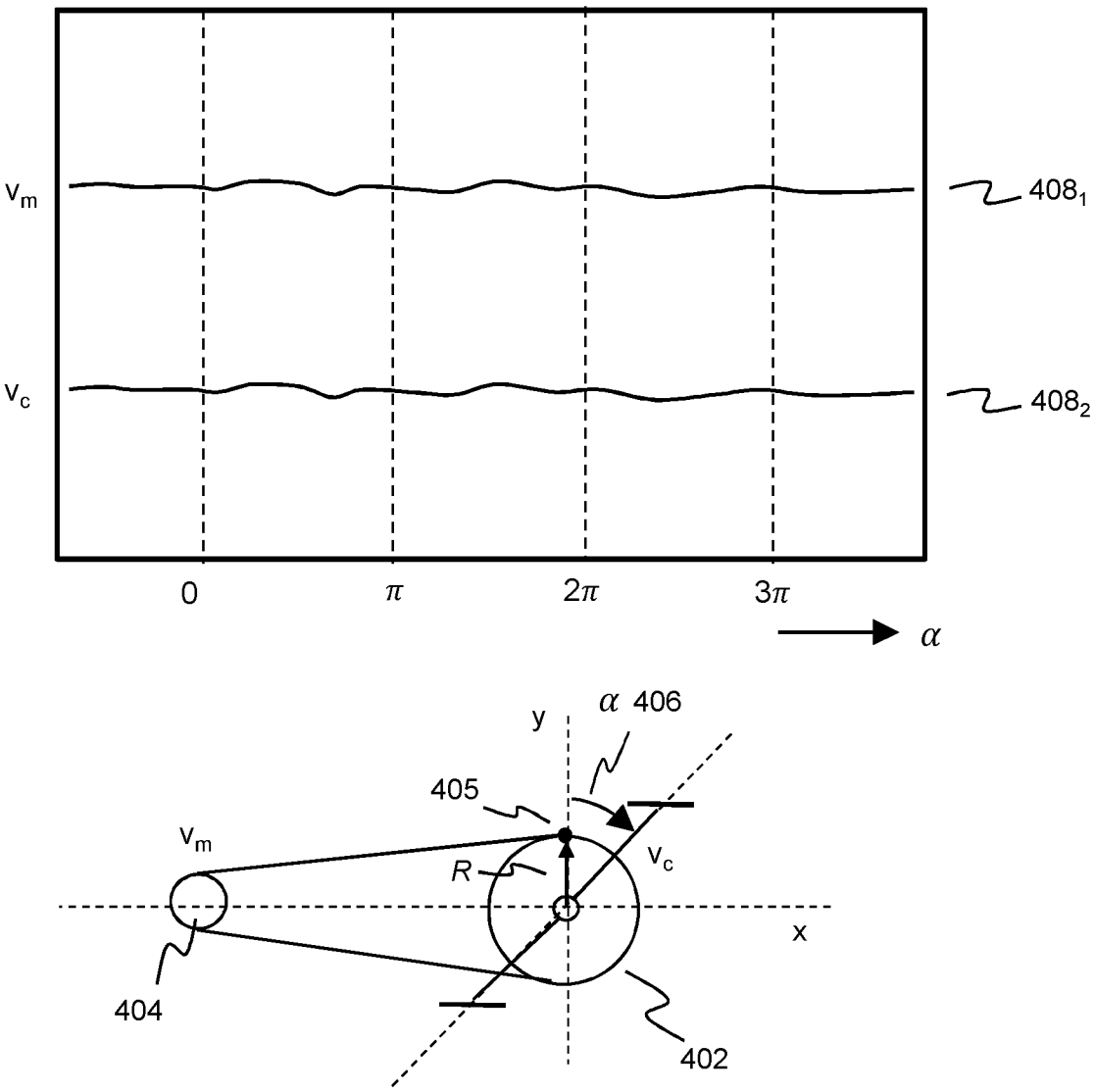
FIG. 4 illustrates a power transmission system comprising a circular gear.

FIG. 4 illustrates a bicycle drivetrain system comprising a circular chainwheel connected to a force generating device. In particular, the figure illustrates a mechanical power transmission structure comprising a crankset including a traditional circular wheel 402 connected a rear axis 404 of a computer-controlled force generating device, e.g. an electric or magnetic motor. The circular wheel may be rotationally connected to the rear axis using any suitable means, e.g. a chain, a belt or a band. Such power transmission structure may be part of an exercise apparatus, e.g. a spinning bike. The motor may be controlled to deliver a certain constant resistive force that is opposite to the force exerted by an athlete to the chain wheel to simulate a bike speed that is approximately constant over a short time interval.

The relation between the angular speed $v_m$ of the motor and the angular speed $v_c$ of the crank as a function of the angular position α 406 of the chainwheel (or the pedals connected thereto) is depicted in the graph. Here, the angular position α may be defined relative to a reference basis, e.g. the y-axis. In case the motor delivers a constant speed $v_m$ 408$_1$, the speed of the crank $v_c$ 408$_1$ will be substantially constant and proportional to the angular speed of the motor. A constant circular gear ratio $E_c$ of the drivetrain may define the relation between the motor and the crank speed.

As the chainwheel is circular, the position of the point of first contact 405 between the chain and the chainwheel is fixed at a distance $R_{chain}$ from the axis of the crankset (which may also be referred to as the first contact point). Here, the distance $R_{chain}$ is equal to the radius of the chainwheel. At the rear-axis, the chain may be connected to a rear wheel of a fixed radius $R_{wheel}$. Hence, in a simple model, the relation between the angular speed of the crank and the angular speed of the motor may be described by the following expression $v_c=v_m/(R_{chain}/R_{wheel}$.

Figure 5:
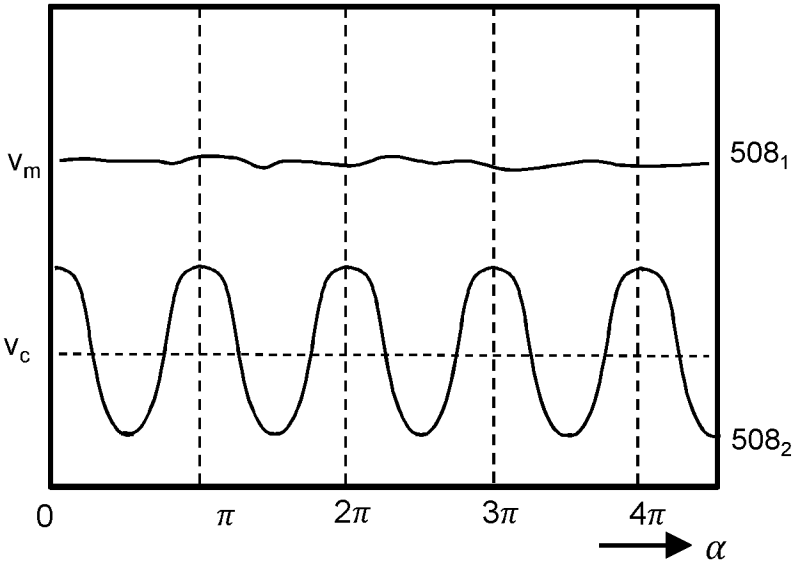
FIG. 5 illustrates a power transmission system comprising a non-circular gear.
Figure 5:
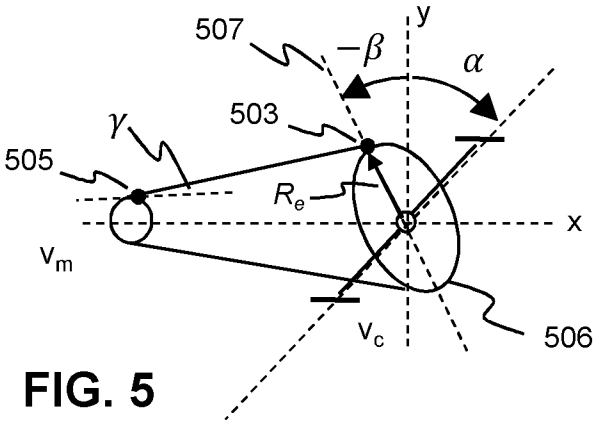

FIG. 5 illustrates a bicycle drivetrain system comprising a non-circular chainwheel, in this example an elliptical chainwheel, which is connected to a force generating device. The figure illustrates a mechanical power transmission structure comprising a crankset including an elliptical chainwheel 502 connected via a chain, a belt or a band to drive a rear axis 504 of a computer-controlled force generating device. As the chainwheel is non-circular, the angular speed of the crank $v_c$ is no longer proportional to the angular speed $v_m$ of the motor by a simple factor. Instead, the angular speed of the crank will depend on the angular position of the crank at a certain point in time α.

The relation between the angular speed $v_m$ of the motor and the angular speed $v_c$ of the crank as a function of the angular position α of the chainwheel is depicted in the graph. In case the motor delivers a constant speed $v_m$ 5081, the speed of the crank $v_c$ 408$_1$ will change as a function of the angular position of the non-circular chainring. An effective gear ratio $E_c(\alpha)$ of the drivetrain comprising a non-circular gear may define the relation between the motor $v_m$ and the crank speed $v_c$ as a function of the angular position.

In this example, the angular speed of the crank will depend on position of the first contact point 503 between the chain and the chainwheel of the crank, which now may change based on the angular position of the chainwheel. When the crankset rotates, the position of the first contact point may move in the x-y plane as a function of the angular position α of the non-circular chainwheel, the diameter of the chain wheel at the first contact point 503, the diameter of the rear chainwheel and the distance between the chain wheels. The angular position α may define the angular position of the crank relative to a reference (in this case the y-axis) as a function of time. The change of the angular position in time (the time derivative dα/dt defines the angular speed of the crank $v_c$.

As shown in the figure, the first contact point may be positioned on the circumference of the non-circular chainwheel. The position of the first contact point may be defined in terms of one or more parameters that are related to the geometry of the non-linear chainwheel. To that end, an effective radius $R_e$ may be defined as the distance between the first contact point of the chain and the axis of the crankset. Further, a first contact angle β may define an angle between the y-axis and a line that runs through the center of the axis of the crankset and the first contact point 503. Additionally, a second contact angle γ may define an angle between the x-axis and a line that runs through the first contact point and a second contact point 505. As shown in the figure, the second contact point may define the contact point between the chain and a chainwheel that is connected to the axis of the motor. When the non-circular gear rotates, both β and γ will change as a function of α. As an example, the relation between the angular speed of the crank and the angular speed of the motor may then be described by the following expression (in which it is implied that α is a function of time):

$$v_c=v_m/(R_c/R_e(\beta(\alpha),\gamma(\alpha)))=v_m/(R_c/R_e(\beta(\alpha)))\cdot\cos(\gamma(\alpha)+\beta(\alpha))) \quad (8)$$

Thus, similar to the situation in FIG. 4, the angular speed as a function of the crank may be expressed in terms of the angular speed of the motor $v_c$ divided by an effective radius $R_e(\beta(\alpha), \gamma(\alpha))$ which now depends on the angular position of the chain wheel.

As shown in the figure, the second contact angle $\gamma$ may be minimal in case the long axis 507 of the elliptical chainwheel is parallel to the x-axis and maximal in case the long axis of the elliptical chainwheel is parallel to the y-axis. Contact angles $\beta$ and $\gamma$ may be fully determined by the geometry of the chainwheel. Hence, equation (8) provides a relation between the angular velocity of the crank $v_c$, the angular velocity of the motor $v_m$, the angular position of the chainwheel and the geometry of the chainwheel. An athlete using an exercise apparatus comprising such non-circular chainwheel will experience a varying angular velocity of the crank, while the angular speed of the motor is constant.

Figure 6:
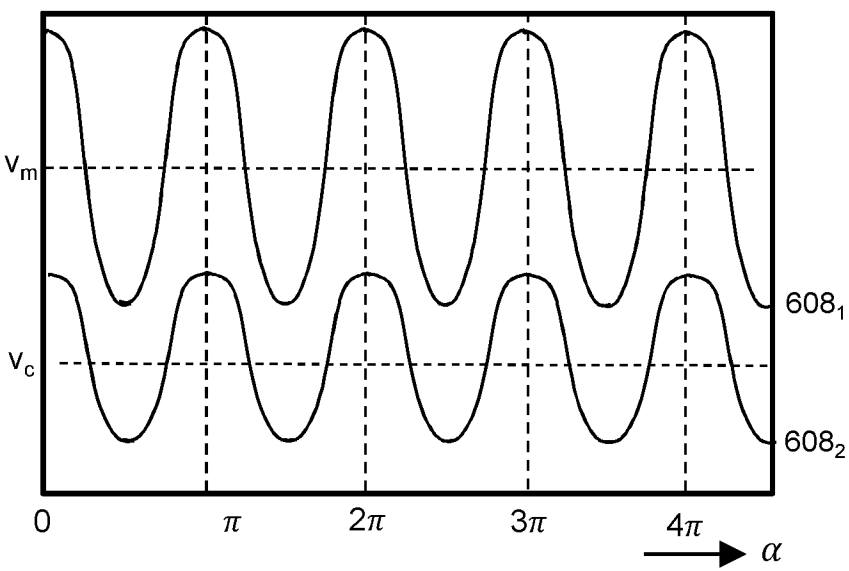
FIG. 6 illustrates a power transmission system comprising a circular gearing that is controlled to mimic a non-circular gearing.
Figure 6:
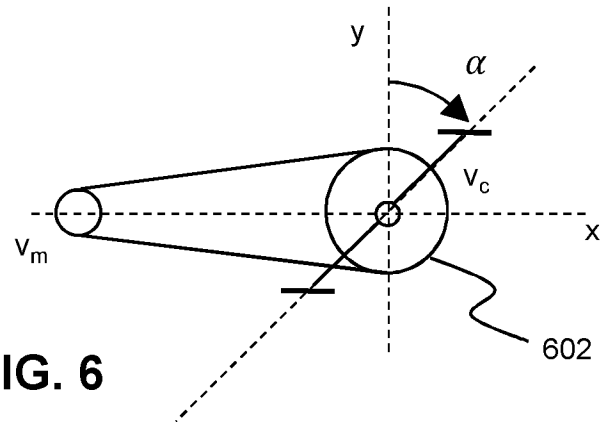

FIG. 6 depicts a bicycle drivetrain system comprising a conventional circular chainwheel of radius $R_c$, which is connected to a force generator which is controlled to mimic the effect of a non-circular gearing. As shown in the graph, controlling the motor to provide a varying non-linear angular motor speed $v_m$ 608$_1$ according to the following expression:

$$v_m = v_{m,av}/(R_c/R_e(\beta(\alpha),\gamma(\alpha))) \tag{9}$$

will cause a similar varying crank speed $v_c$ 608$_2$ as the speed of the crank is linear related to the speed of the motor. Here, $v_{m,av}$ is an average angular speed of the motor that follows from the kinematic equations, $R_c$ is radius of the circular chainwheel and $R_e$ is an effective diameter of a non-circular chainwheel as described above with reference to expression (8).

The effective radius $R_e$ may be described using more or less geometrical factors. For example, in case $\gamma$ and its variations are very small, its contribution can be neglected so that the first contact angle may be written as a function of the angular position and the geometry of the non-circular chainwheel: $\beta(\alpha)=f(\alpha, \text{geometry})$. This way, the motor may be controlled to provide a non-linear motor speed as a function of the angular position of the crank as defined according to the above expression, thereby providing a user of an exercise apparatus an experience of a bicycle with a non-circular, e.g. an elliptical, chainwheel. The non-linear angular speed $v_m$ as defined by expression (9) includes the geometry of the chainwheel, which can be defined based on one or more geometrical parameters such as contact angles $\gamma$ and $\beta$. This way, different chainwheel geometries may be modelled and simulated by simply changing one or more parameters that define the geometry of the non-linear chainwheel.

Figure 7:
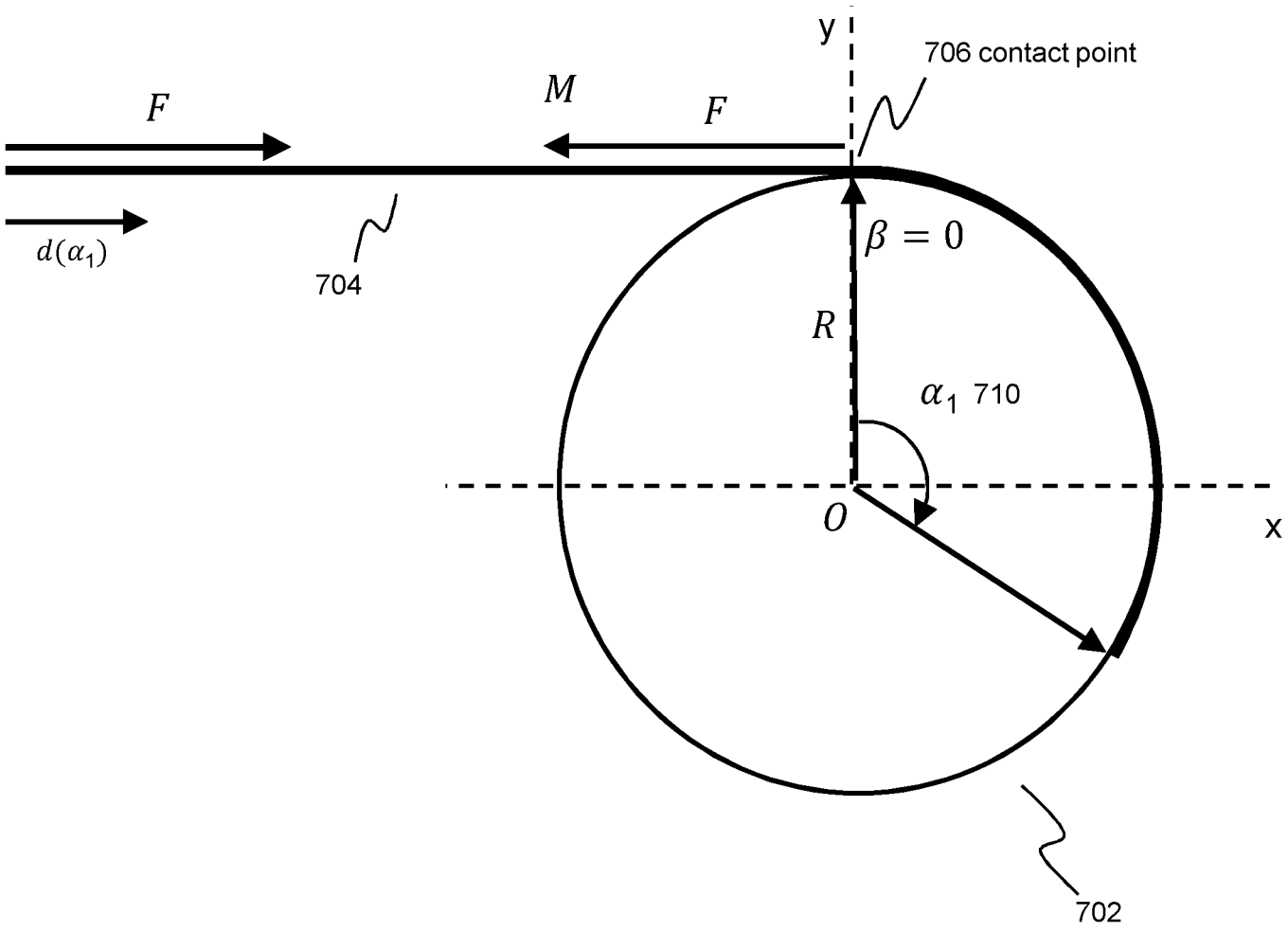
FIG. 7 depicts a power transmission structure comprising a circular gear.

As will be described hereunder in greater detail, contact angles $\gamma$ and $\beta$ may be determined as a function of the angular position $\alpha$. FIG. 7 depicts part of a conventional power transmission system based on a circular gearing. The power transmission system may include (part of) a belt drive or chain 704 and a first circular gear wheel 702, which may be part of a power transmission system as described with reference to FIG. 4. The first gear wheel may have a radius R and the contact angle $\beta$ of the first contact point 706 of the chain or belt is constant because the first gear wheel is circular. As the contact angle is determined relative to the y-axis, contact angle $\beta$ may be set to zero. For simplicity, it is assumed that $\gamma$ is very small so that its contribution is negligible. Further, the belt or chain may run with a certain friction over the surface of the wheel and may be connected via a second circular gear wheel to a force generator such as a motor (not shown).

A pulling force F may be applied on the belt so that in response the belt may exhibit a displacement d. Further, the force will generate a torque M so that the angular position of the wheel may change from zero to angular position $\alpha_1$ 710. For this system the following relations between the force, torque, radius and displacement exist:

$$F = \frac{M}{R} \tag{10}$$

$$d = \int_0^{\alpha_1} \sqrt{R^2 + \left(\frac{dR}{d\alpha}\right)^2} \cdot d\alpha = R \cdot \alpha_1 \tag{11}$$

Thus as the effective radius of the circular gear wheel is constant and displacement d can be simply approximated by $d \approx R \cdot \alpha_1$ The displacement for subsequent angular positions $\alpha$ of the first circular gear wheel can be computed and these computed values may be used to determine the associated angular position of the second circular gear wheel of radius r that is connected to the force generator. The rotational displacement the first and second circular gear wheels will determine the gear ratio of the power transmission system.

In case of a non-circular gear wheel, the relations between the various parameters become more complex and depend on contact angles $\beta$ and $\gamma$ which may depend on the angular position $\alpha$ of the non-circular gear wheel.

Figure 8A:
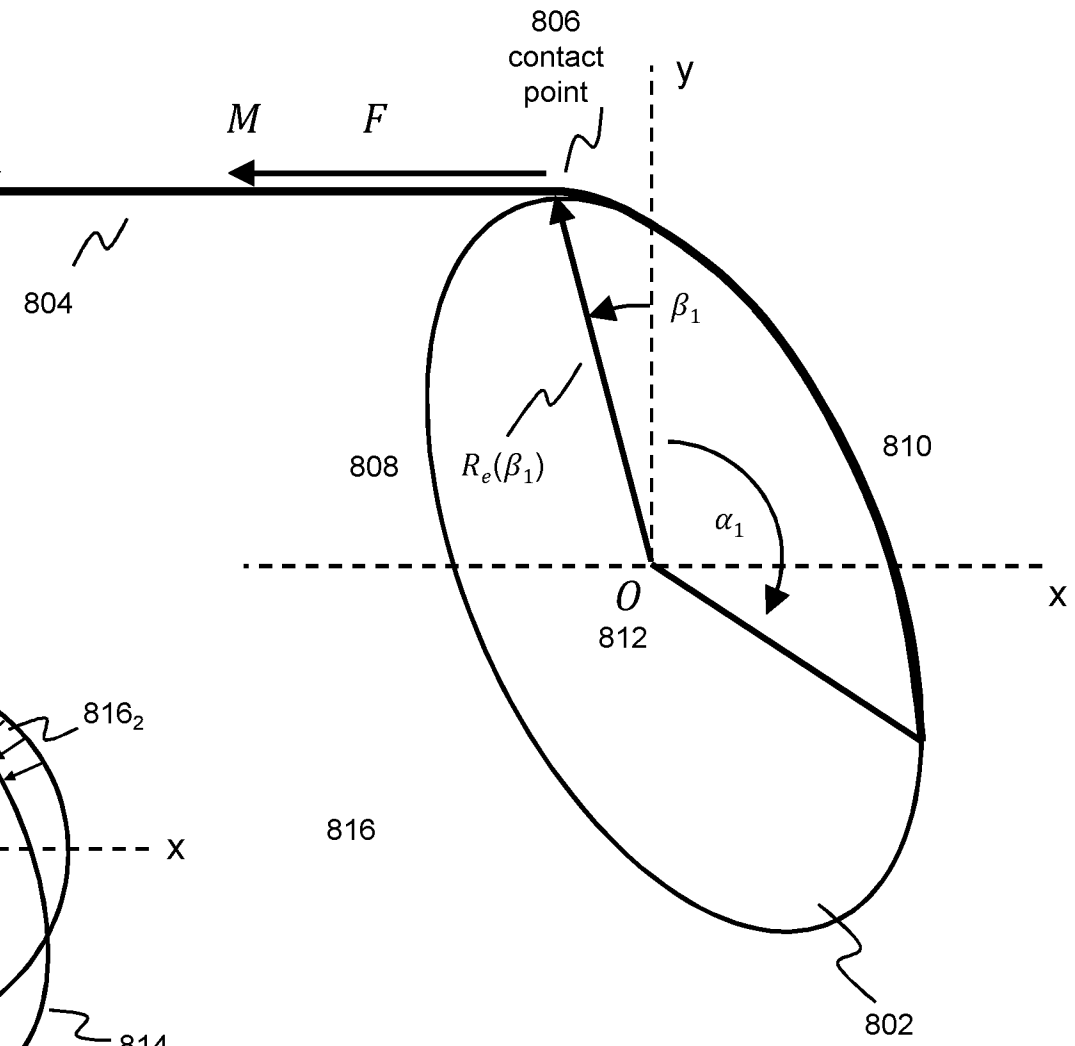
FIGS. 8A and 8B depict a power transmission structure comprising an elliptical gear.
Figure 8B:
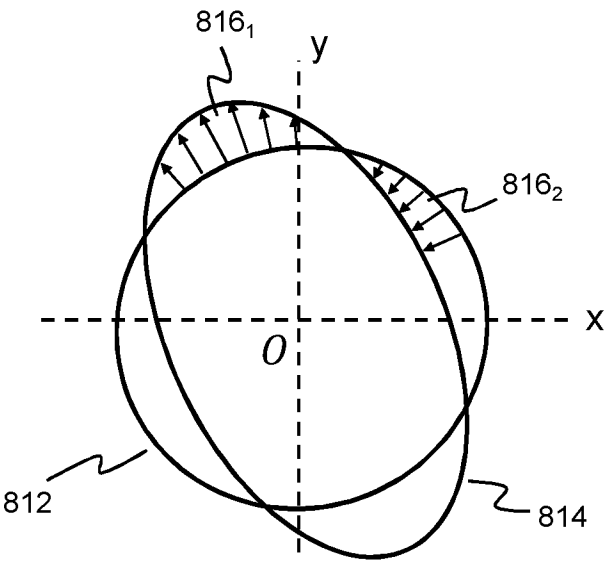

FIGS. 8A and 8B depict schematics of part of a power transmission system based on a non-circular gearing, in this example an elliptical or oval gearing, rotatable connected around center 812. As shown in FIG. 8A power transmission system may include (part of) a belt drive or chain 804 and a first circular gear wheel 802, which may be part of a power transmission system as described with reference to FIG. 5. A first contact point 806 of the chain or belt may be defined which is associated with contact angle $\beta$ which will vary as a function of the angular position $\alpha$. The belt or chain may run with a certain friction over the surface of the wheel and may be connected via a second circular gear wheel to a force generator such as a motor (not shown).

A pulling force F may be applied on the belt so that—in response—the belt may exhibit a displacement d. Further, the force will generate a torque M so that the angular position of the wheel may change from zero to angular position $\alpha_1$. For this system, the following relations between the force, torque, radius and displacement exist (where for simplicity it is assumed that gamma is zero, but the effect of gamma may be easily included in the equations below):

$$F = \frac{M}{\cos\beta(\alpha) \cdot R_e(\beta(\alpha))} \tag{13}$$

$$d = \int_{\alpha=-\beta}^{\alpha=\alpha_1} \sqrt{R_e(\alpha)^2 + \left(\frac{dR_e(\alpha)}{d\alpha}\right)^2} \cdot d\alpha - R_e(\beta(\alpha))\sin(\beta(\alpha)) \tag{14}$$

Thus, based on these equations, displacement d may be calculated taking into account that the wheel is non-circular, in this case elliptical.

The particular geometry of the gear wheel may fully described by the contact angle β as a function of the angular position. For some geometries, it may be possible to determine an analytical expression of the contact angle β. However, for more complex geometries, β needs to be determined iteratively. An example of an algorithm for determining β iteratively may look as follows:

```
α_new=α;
β_new=β;
while α_new<α_desired
  α_new=α_new+α_step wherein α_step«1
  β_test=β_new+a_step
  while β_test>−π/2
    β_test=β_test−β_step wherein β_step «1
    if (R(β_test)·cos(β_test))>(R(β_new)·cos(β_new))
      // if true a new contact point is found//
    β_new=β_test
    end if
  end while
end while
α=α_new;
β=β_new;
```

wherein R(β) defines a radius for the contact angle β as depicted in FIG. 8A. The algorithm introduces a small increase of the angular position and looks for the associated contact angel. The calculation of contact angle β does not need to be repeated for every revolution. Instead, the calculated values β can be stored in a lookup table as a function of the angular positions α. Hence, based on the above-described algorithm, β may be determined for a certain geometry as a function of a. Once calculated, these values may be used by the computer to control the force generator to produce a predetermined non-linear resistive force that may accurately mimic a real bike ride using an elliptical chainwheel.

Based on the contact angle β, for every angular position α of the non-circular gear, an effective radius R of the gear wheel may be computed. These values may be stored in the lookup table as well. Additionally, given the angular position α, the contact angle β and the effective radius R, the distance d the chain has displaced can be calculated and stored in the lookup table. From these values, the effect of the non-circular geometry on the speed of the non-circular gear can be calculated for every angular position as given by equation (7) above: $v'=v\cdot s(\alpha)$, wherein v' represents the angular velocity of the non-circular gear and the v the angular velocity of the motor. This way the angular speed of the motor may be determined $v=v'/s(\alpha)$.

The values of the contact angles for different angular positions can be determined for different geometries in advance and can be used by the computer to produce a non-linear force feedback that mimics the effect of a non-circular gearing. Contact angles for different non-circular gearing geometries can be determined and stored a lookup table for future use. This way, the invention allows efficient personalization of non-circular chain wheels based on their geometry.

FIG. 8B provides a schematic illustrating the use of the angular position dependent geometrical scaling values. Based on the angular position of a gear or axle 812 of the exercise apparatus, angular-dependent scaling values $\mathbf{816}_{1,2}$ may be used to transform (topologically deform) a first geometry (shape) of the gear or axle 812, e.g. a circular geometry, into a second geometry 814 (shape) of a gear that is non-circular, e.g. ellipse or oval shaped. As shown in the figure, scaling values $\mathbf{816}_1$ may be positive, deforming the boundary of the circular shape 812 outwardly (away from the origin O) and/or scaling values $\mathbf{816}_2$ may be negative, deforming the boundary of the circular shape inwardly (towards the origin O). In an embodiment, the geometrical scaling values may be determined such that the circumference of the second, non-circular geometry is equal or substantially equal to the circumference of the first circular shape.

Incorporating the angular position dependent geometrical scaling values into the kinematic model of an exercise apparatus will result in a modified kinetic model. When controlling the force generator of the exercise apparatus on the basis of this modified kinetic model, the user will experience as if the exercise apparatus is equipped with the non-circular gear.

Figure 9:
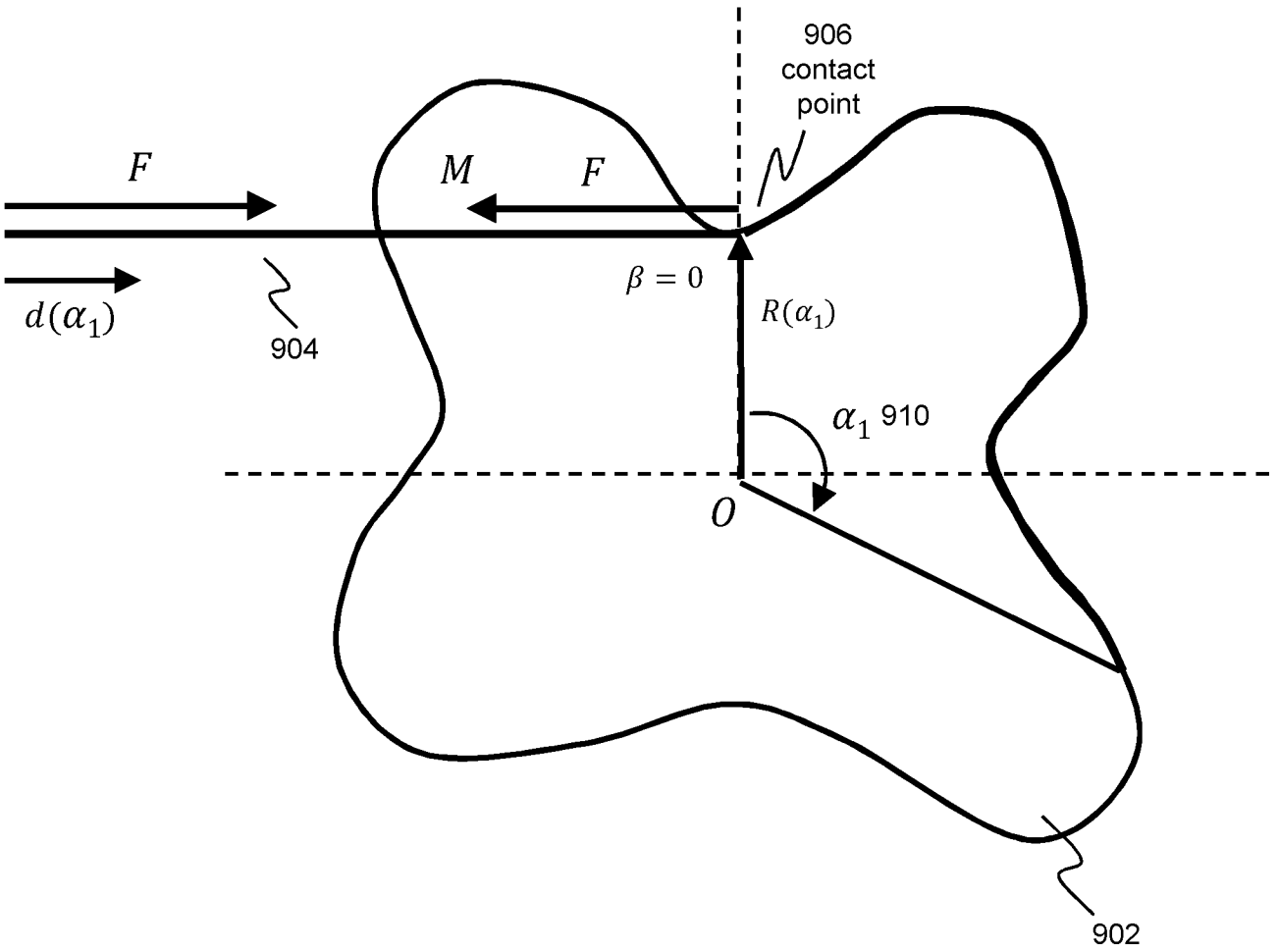
FIG. 9 depicts a power transmission structure comprising a non-circular gear.

FIG. 9 depicts a further schematic of part of a power transmission structure including a non-circular wheel. As shown in this example, the shape of the wheel may have an irregular shape, including shapes that would not be possible in real-live, but still can be used to achieve certain desired effects. For example, in some situations, it would be desirable to force the chain to follow the entire path of the wheel, e.g. for introducing (high-frequency) vibrations, starting at a fixed contact point as depicted in FIG. 7, i.e. contact angle β=0. Nevertheless, due to the particular non-circular geometry of the wheel, the effective radius R(α) will change as a function of the angular passion. The equations for the force F and displacement d of the chain the equations may look as follows:

$$F(\alpha) = \frac{M}{R(\alpha)} \tag{15}$$

$$d = \int_0^{\alpha_1} \sqrt{R(\alpha)^2 + \left(\frac{dR(\alpha)}{d\alpha}\right)^2} \cdot d\alpha \tag{16}$$

It should be noted that the above described parameters and formulas are used to illustrate the invention. It is clear for a skilled person that alpha, beta and gamma can be chosen with respect to an arbitrary coordinate system, as long as they are used consistently.

Further, it should be noted that for certain geometries (elliptical for instance), the associated formulas can also be solved exactly or approximated and therefore the use of a lookup table as described above is not needed, provided enough computational power is available. During use, instantiations torque values as a function of the rotary position alpha of the chain wheel are measured by a torque sensor. For each a, an effective radius R(β) of the chain wheel can be determined.

Figure 10:
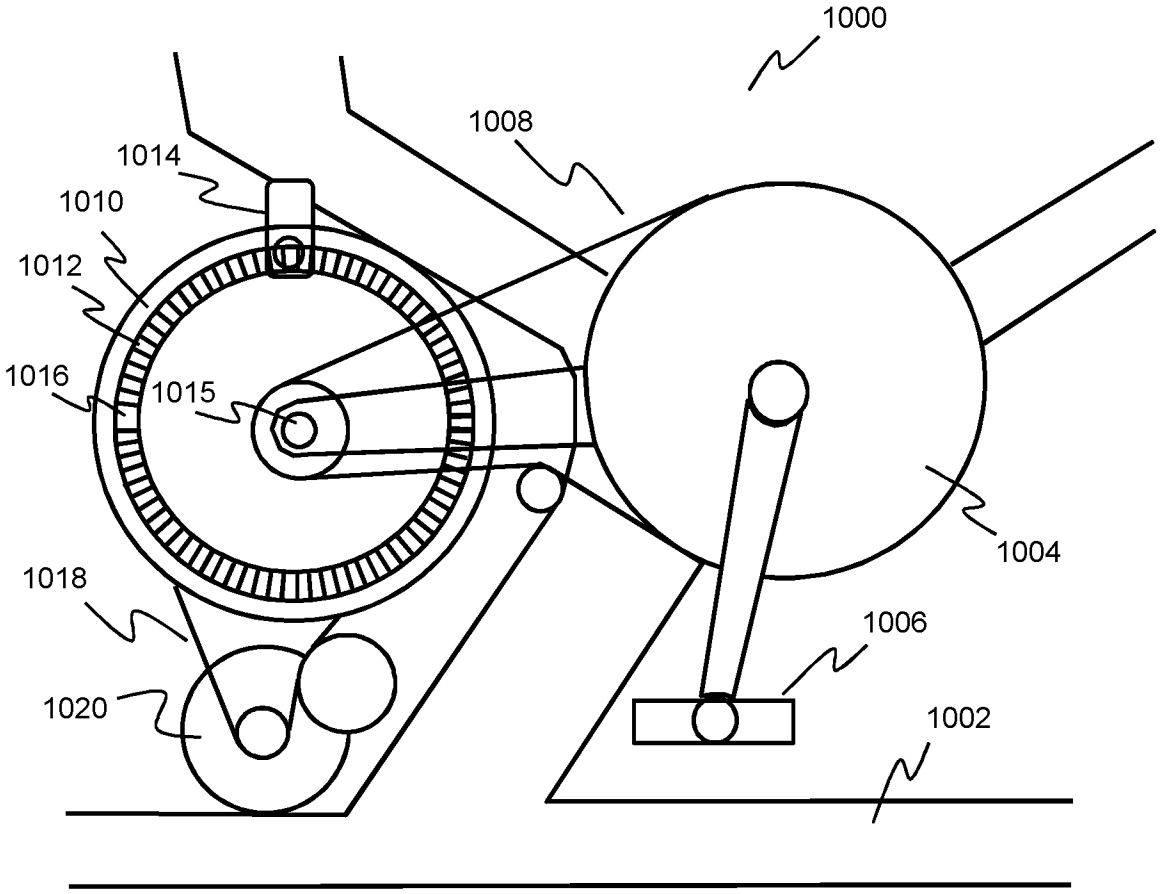
FIG. 10 depicts a schematic of an exercise apparatus comprising a controller for the force generator according to an embodiment of the invention.
Figure 11:
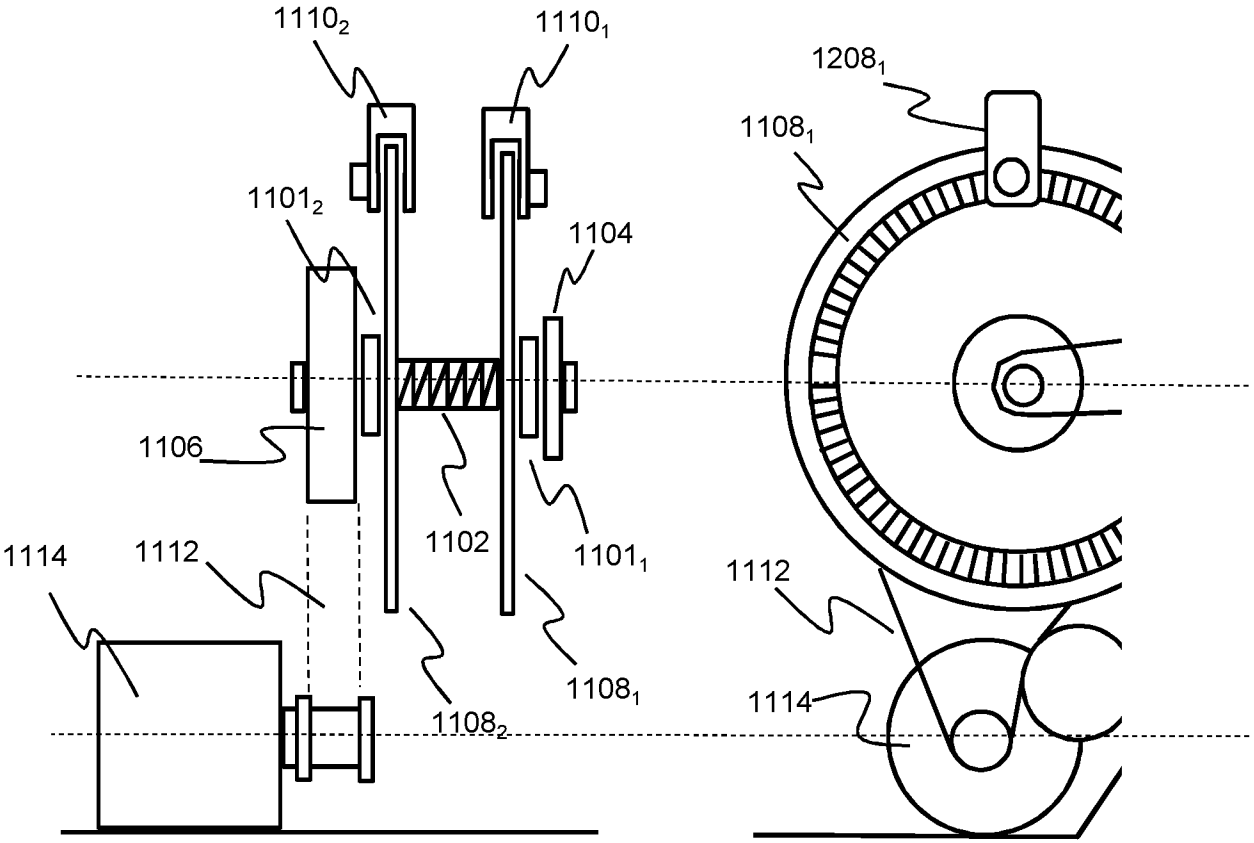
FIG. 11 depicts a schematic of an exercise device comprising a controller for the force generator according to an embodiment of the invention.

FIGS. 10 and 11 depicts part of a computer-controlled exercise apparatus that is particularly suitable for use with the embodiments in this application. Exercise apparatus that are especially suitable for using the embodiments in this application are described in pending PCT application PCT/NL2019/050661 with title "a torque sensing system" which is hereby incorporated by reference in the description of this application.

FIG. 10 depicts a schematic of a part of a spinning bike comprising a computer-controlled force generator according to an embodiment of the invention. In particular, this figure depicts the side face of part of an exercise apparatus 1000, in this case a stationary bike, comprising a frame 1002 supporting a force receiving structure, i.e. the force receiving structure in the form of a force crank 1004 with pedals 1006, wherein the crank is rotatable connected via a chain 1008 to a back gear 1015. Here, the back gear is connected to a first part (e.g. a first end) to a rotatable shaft. The first part of the shaft is further connected to a first encoder disc 1010 comprising position indicators 1012, e.g. slots, that are arranged along the periphery of the first encoder disc. A detector 1014 is located at the position of the position indicators so that when the apparatus is in use, the first encoder disc will rotate in reaction to a force exerted on the first part of the shaft and the position indicators sequentially pass the detector, which detects the passing slots.

The position indicators may include a reference readout element 1116 which provides a reference signal. The reference signal may be used by the computer to detect the start of a new rotation and provides a reference position relative to the positions of position indicators. A force generating device 1120 is rotatable connected via a belt or a chain 1108 to a second part of the shaft, wherein the second part of the shaft is connected to a second rotary disc, which can be readout by a second detector (not shown).

FIG. 11 depicts a schematic of another side view of the spinning bike as described with reference to FIG. 10. This figure illustrates the arrangement of the rotatable shaft 1102 comprising a first part $\mathbf{1101}_1$ and a second part $\mathbf{1101}_2$. The shaft may comprise a deformable spring structure between the first and second part. Further, the shaft is rotatable mounted to the frame of the stationary bike and includes a gear unit 1104 at a first end of the shaft and a driving wheel 1106 at the second end of the shaft. A first encoder disc $\mathbf{1108}_1$ including a plurality of first position indicators is connected to the first part of the shaft and a second encoder disc $\mathbf{1108}_2$ comprising a plurality of second position indicators is connected to the second part of the shaft. When a force is exerted on the first part of the shaft, the shaft starts to rotate and the first and second encoder discs are read out by a first detector 11101 and second detector $\mathbf{1110}_2$ respectively, wherein a periodic signal generated by the first detector represents location information of the first part of the shaft and the periodic signal generated by the second detector represents location information of the second part of the shaft. Here, the driving wheel may be rotatable connected via a driving belt 1112 to a driving wheel of a computer-controlled electronic motor 1114, which is configured to produce a brake force which will be applied as a second torque to the second part of the shaft. The shaft—encoder arrangement provides a compact design which can be easily integrated in a conventional exercise apparatuses, such as an exercise bicycle.

Figure 12:
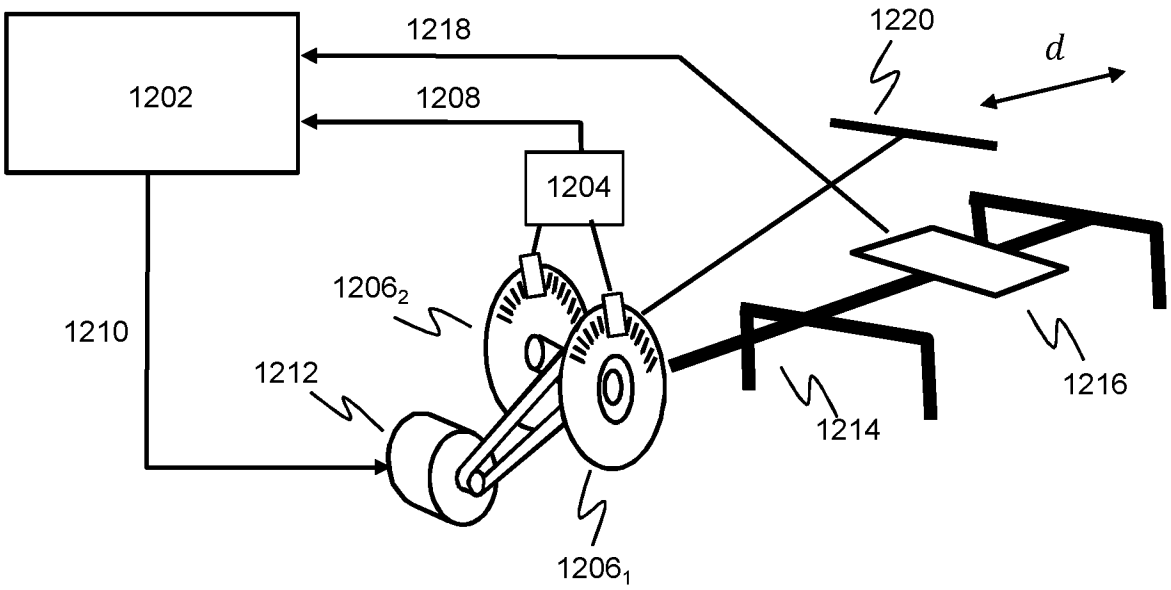
FIG. 12 depicts a schematic of an exercise apparatus comprising a controller for the force generator according to an embodiment of the invention.

FIG. 12 depicts a computer-controlled rowing exercise apparatus which may use the embodiments in this application. In particular, FIG. 12 depict part of exercise apparatus comprising a computer 1202 connected to an encoder system 1204 that is configured to read out rotary positions of a first part $\mathbf{1206}_1$ and second part $\mathbf{1202}_2$ of a rotatable shaft, wherein the rotatable shaft comprises a spring structure of a predetermined spring behavior, e.g. a predetermined spring constant. If a first torque is applied to the first part of the rotatable shaft, the encoder system generates position information 1208 of the first and second part of the shaft and the computer uses this information in order to determine an angle of twist of the shaft. The computer may use the angle of twist to control a force generating device 1212 by sending a feedback signal 1210 to the force generating device to generate a second torque to the second part of the shaft. Additionally, a third encoder configured to measure third position information. In this case, the third position information may be associated with a position of a body part of the user of the exercise apparatus.

The rotatable shaft may be mounted on the frame 1214 of the exercise apparatus. The frame may include a slidable seat 1216 and a footrest structure connected to the frame. The first part of the shaft may be connected to a rotary mechanism including a chain or a cord connected to a handle 1220 (representing the oar). The rotary mechanism of the rowing exercise apparatus is configured to enable a user to exercise strokes wherein each stroke includes a catch position (the start position), a drive phase wherein the user generates power up to the release (the end of the stroke) and a recovery phase wherein the rower slides back to the catch position.

During the drive phase, the user exerts a force onto the first part of the shaft by a pull mechanism, during this phase the encoder system may provide position information of the first and second part of the shaft. Further, the third encoder may determine third position information 1218 representing the position of the user during stroke actions to the computer and the computer will use this information to control a force generating device to exert a second torque on the shaft that is opposite to the first torque. Hence, the third encoder may be configured to determine for example the position of the slidable seat using a linear position encoder. The computer may use the position of the seat to determine if the user is in a catch, drive, release or recovery position and to generate a suitable non-linear force accordingly.

Thus, as described above, scaling functions may be computed for chainwheels of different geometries. These scaling values can be determined for any geometry in advance or can be recomputed as the (virtual) geometry changes. This principle can be used by the computer of the exercise apparatus to (continuously) change the geometry of the non-circular gearing. This way the effect of variations in the chain wheel geometry can be mimicked and used in an optimization scheme. By iteratively changing the geometry and measuring responses of the athlete an optimal geometry may be determined.

Figure 13:
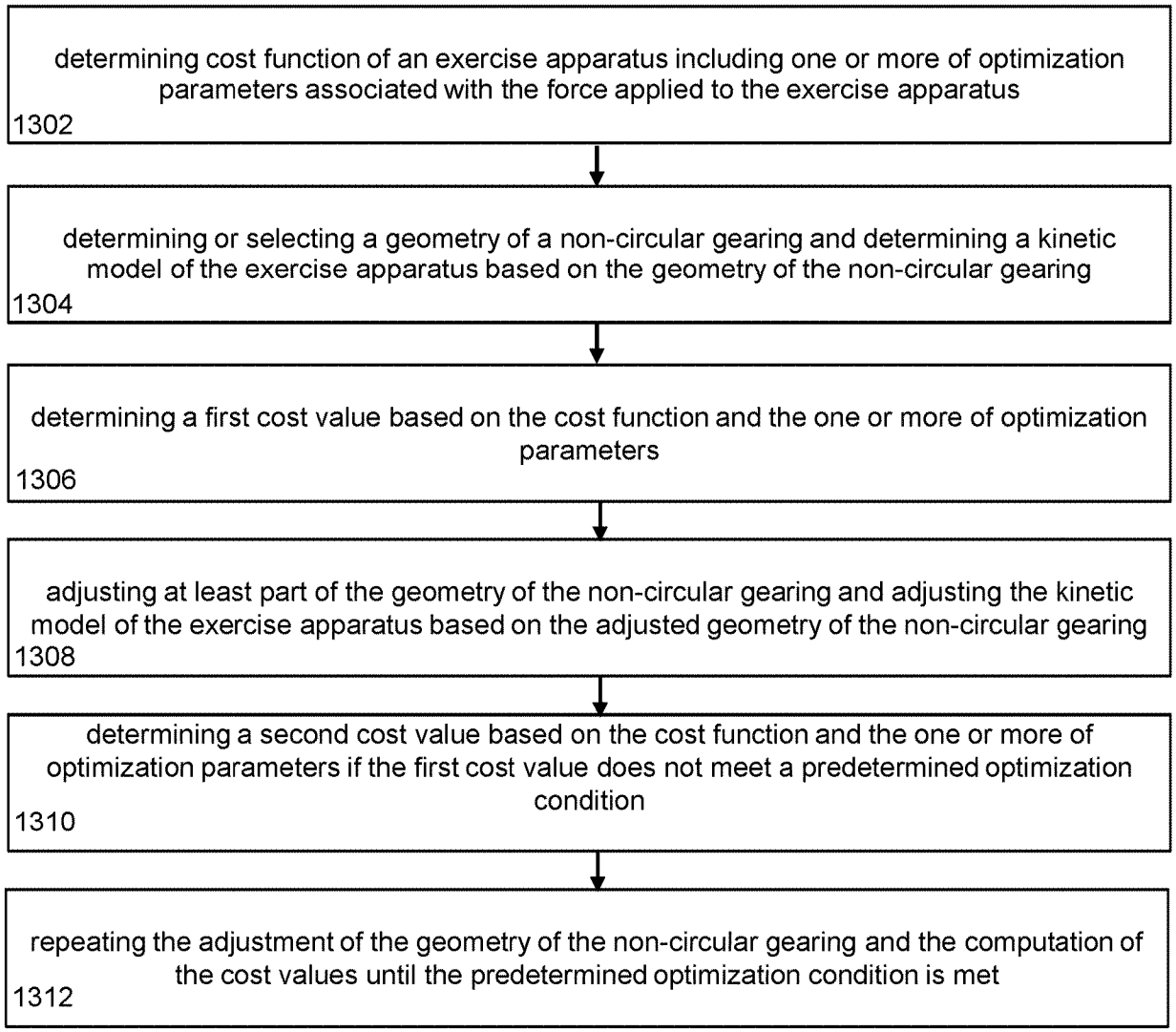
FIG. 13 depicts a flow diagram of optimizing a geometry of a gear of an exercise apparatus based the embodiments of the application.

FIG. 13 depicts a method for determining an optimal non-circular gearing using an exercise apparatus according to an embodiment of the invention. The method may be executed by a module in the computer of the exercise apparatus, e.g. optimization module 330 as described with reference to FIG. 3.

The method may include determining a cost function of an exercise apparatus which may be used to minimize a loss value associated with measured physical quantity of the exercise apparatus such as force or angular velocity (step 1302). The loss value may be computed on the basis of the cost function. For example, the peak angular velocity or the peak force may be minimized based on the cost function. Alternatively, fluctuations in the angular velocity or applied force may be minimized based on the cost function.

Further, a geometrical scaling function associated with a geometry of a non-circular gear may be determined or selected and a kinetic model of the exercise apparatus may use the geometrical scaling function and a measured force applied to a force receiving structure of the exercise apparatus to control a force generator of the exercise apparatus (step 1304). A kinetic model of the exercise apparatus may use the geometrical scaling function and a measured force applied to a force receiving structure of the exercise apparatus to control a force generator. The force generator is controlled to generate a resistive force to counter the force applied by the athlete to mimic an exercise apparatus comprising a non-circular gearing.

When the exercise apparatus is used by the athlete, a loss value may be determined based on the cost function, wherein the loss value is associated with a measured physical quantity of the exercise apparatus and the geometry of the non-circular gear and the associated geometrical scaling function may be adjusted if the loss value does not comply with an optimization condition (step 1306). If the loss value does not comply with the optimization condition, then the geometry of the non-circular gearing may be adjusted and the geometrical scaling function may be adjusted based on the adjusted geometry of the non-circular gearing. Thereafter, the kinetic model of the exercise apparatus may use the adjusted geometrical scaling function and a measured force applied to a force receiving structure of the exercise apparatus to control a force generator.

Thus, the steps of determining of further loss values and further adjustments of the geometry of the non-circular gear and the associated geometrical scaling function may be repeated until a loss value complies with the optimization condition (step 1308). Once, the optimization condition is met, a data structure representing the geometry of the non-circular may be generated and stored as a data file on a storage medium of a computer (step 1310). The data structure may be used to control a computer-controlled manufacturing system to manufacture a non-circular gear (step 1312).

The optimized non-circular geometry may be stored as a data file in the memory of the computer of the excursive apparatus. Alternatively and/or in addition, the data file representing the optimized non-circular geometry may be transmitted to a central server for storing the data file. In an embodiment, the data file may be formatted according to a predetermined data format, such as a preferably CAD file or an STL file, so that the data file can be used by a computer-controlled manufacturing system. In an embodiment, the computer-controlled manufacturing system may be a 3D printer for printing a non-circular gearing based on the optimized geometry.

An optimization method may be used to determine the optical geometry for a particular person. One method commonly used is one where a relationship is defined between a variable that has been measured for the athlete (speed, position, heart rate, etc.) or that can be derived (energy, distance travelled, etc.) and a goal that one needs to attain (maximize velocity, minimize velocity deviations, make constant, etc.). By relating the biggest deviation (error) from the goal to the simulation of the non-circular gearing, one may efficiently determine the effect by slightly changing the underlying geometry in such a manner that a particular modelled non-round gearing provides that the error is reduced. This may be done iteratively to converge to a geometry that exhibits optimal performance according to certain conditions for a particular user or a group of users. The optimization of the geometry of the non-circular gearing may be based on power or peak loads.

Furthermore, the above-described simulation of non-circular chainwheels offers the possibility to change the underlying geometry of the fictive chainwheel on the fly. For example, the geometry may be changed while measuring the power produced by the athlete under certain conditions. Once an optimal geometry of the chain wheel is determined, the geometry may be used for production, e.g. by using a 3D printing process or the like. Hence, in that case, the design of the chainwheel may be stored in a CAD file or an automatically generated CAM file.

The adjustment of the geometry of the non-circular geometry may be done manually, e.g. by a user of the exercise apparatus interacting with the UI of the computer of the exercise apparatus. Alternatively and/or in addition, the adjustment may be executed automatically by the optimization module based on some rules.

Figure 14:
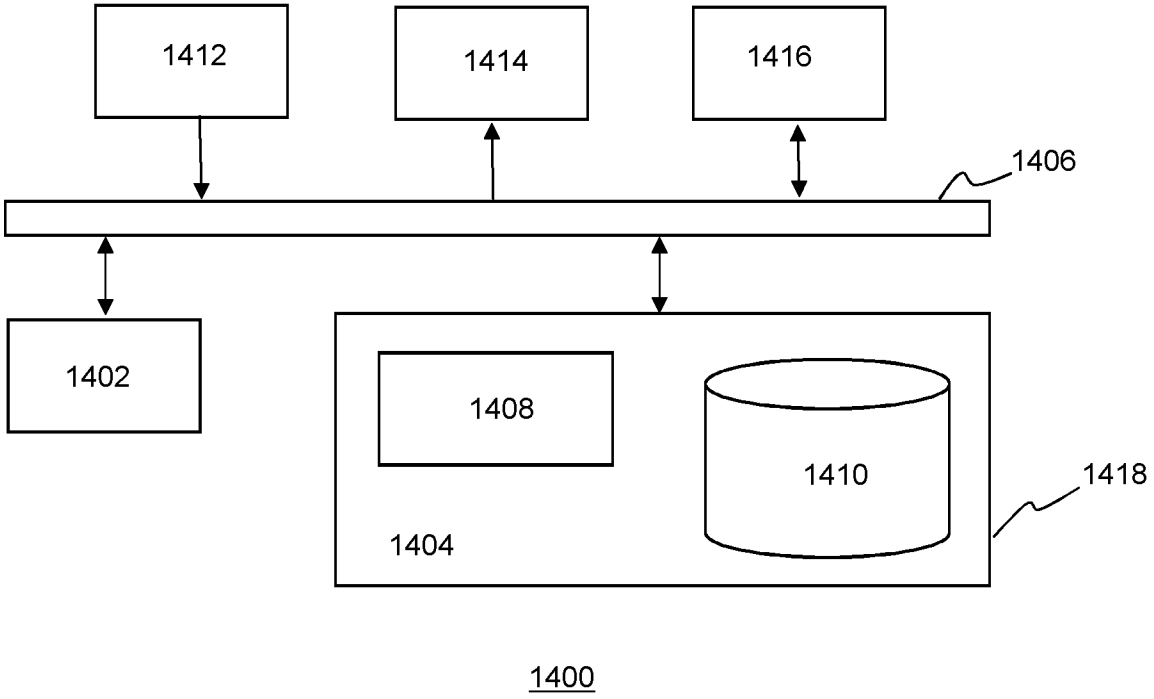
FIG. 14 is a block diagram illustrating an exemplary data processing system that may be used in as described in this disclosure.

FIG. 14 is a block diagram illustrating an exemplary data processing system that may be used in as described in this disclosure.

FIG. 14 is a block diagram illustrating an exemplary data processing system that may be used in as described in this disclosure. Data processing system 1400 may include at least one processor 1402 coupled to memory elements 1404 through a system bus 1406. As such, the data processing system may store program code within memory elements 1404. Further, processor 1402 may execute the program code accessed from memory elements 1404 via system bus 1406. In one aspect, data processing system may be implemented as a computer that is suitable for storing and/or executing program code. It should be appreciated, however, that data processing system 1400 may be implemented in the form of any system including a processor and memory that is capable of performing the functions described within this specification.

Memory elements 1404 may include one or more physical memory devices such as, for example, local memory 1408 and one or more bulk storage devices 1410. Local memory may refer to random access memory or other non-persistent memory device(s) generally used during actual execution of the program code. A bulk storage device may be implemented as a hard drive or other persistent data storage device. The processing system 1400 may also include one or more cache memories (not shown) that provide temporary storage of at least some program code in order to reduce the number of times program code must be retrieved from bulk storage device 1410 during execution.

Input/output (I/O) devices depicted as input device 1412 and output device 1414 optionally can be coupled to the data processing system. Examples of input device may include, but are not limited to, for example, a keyboard, a pointing device such as a mouse, or the like. Examples of output device may include, but are not limited to, for example, a monitor or display, speakers, or the like. Input device and/or output device may be coupled to data processing system either directly or through intervening 1/O controllers. A network adapter 1416 may also be coupled to data processing system to enable it to become coupled to other systems, computer systems, remote network devices, and/or remote storage devices through intervening private or public networks. The network adapter may comprise a data receiver for receiving data that is transmitted by said systems, devices and/or networks to said data and a data transmitter for transmitting data to said systems, devices and/or networks. Modems, cable modems, and Ethernet cards are examples of different types of network adapter that may be used with data processing system 1450.

As pictured in FIG. 14, memory elements 1404 may store an application 1418. It should be appreciated that data processing system 1400 may further execute an operating system (not shown) that can facilitate execution of the application. Application, being implemented in the form of executable program code, can be executed by data processing system 1400, e.g., by processor 1402. Responsive to executing application, data processing system may be configured to perform one or more operations to be described herein in further detail.

In one aspect, for example, data processing system 1400 may represent a client data processing system. In that case, application 1418 may represent a client application that, when executed, configures data processing system 1400 to perform the various functions described herein with reference to a "client". Examples of a client can include, but are not limited to, a personal computer, a portable computer, a mobile phone, or the like. In another aspect, data processing system may represent a server. For example, data processing system may represent an (HTTP) server in which case application 1418, when executed, may configure data processing system to perform (HTTP) server operations. In another aspect, data processing system may represent a module, unit or function as referred to in this specification.

The techniques of this disclosure may be implemented in a wide variety of devices or apparatuses, including a wireless handset, an integrated circuit (IC) or a set of ICs (e.g., a chip set). Various components, modules, or units are described in this disclosure to emphasize functional aspects of devices configured to perform the disclosed techniques, but do not necessarily require realization by different hardware units. Rather, as described above, various units may be combined in a codec hardware unit or provided by a collection of interoperative hardware units, including one or more processors as described above, in conjunction with suitable software and/or firmware.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The invention claimed is:

1. A computer-implemented method of controlling a force generator of an exercise apparatus, the method comprising:

determining or receiving angular positions of a rotatable axle of the exercise apparatus when a force is applied to a force receiving structure of the exercise apparatus, the rotatable axle connecting the force receiving structure to the force generator which is controlled by a computer based on a kinetic model, the kinetic model being based on equations of motion of an exercise on the exercise apparatus;

determining or retrieving first geometrical scaling values associated with the angular positions and using the first geometrical scaling values in the kinetic model to form a first modified kinetic model, the first geometrical scaling values being used for simulating a first non-circular gear of a first predetermined non-circular geometry; and determining applied force values for the angular positions, each of the applied force values representing the force that is applied to the force receiving structure; and, controlling the force generator based on first resistive force values so that the exercise apparatus behaves an exercise apparatus comprising a mechanical power transmission system including the first non-circular gear, the first resistive force values being computed using the first modified kinetic model and the applied force values.

2. The method according to claim 1, wherein the rotatable axle is connected to the force receiving structured based on a mechanical power transmission system comprising a circular chain wheel rotatable connecting the force receiving structure via the axle to the force generator using a chain or a belt.

3. The method according to claim 2, wherein at least part of the first geometrical scaling values is determined based on a relative position of a first point of contact between the chain or belt and the first non-circular gear, the relative position of the first point being dependent on the angular positions.

4. The method according to claim 1, wherein the first geometrical scaling values are determined based on a geometrical scaling function or wherein the first geometrical scaling values are retrieved by accessing a look-up table.

5. The method according to claim 1, wherein the first geometrical scaling values define a wheel or gear of a non-circular shape and the first geometrical scaling values mimics the exercise apparatus to be equipped with the wheel or the gear of the non-circular shape.

6. The method according to claim 1 wherein the mechanical force transmission system comprises a band, a belt or a chain for connecting a first circular wheel of the mechanical force transmission system to a second circular wheel of the mechanical force transmission system, the first wheel being connected to the force generator and the second wheel being connected to the force receiving structure.

7. The method according to claim 1, wherein determining angular positions of the rotatable axle includes:

receiving position information associated with angular positions of the rotatable axle.

8. The method according to claim 1, wherein determining for a least part of the angular positions applied force values includes:

receiving information about a deformation of at least part of the mechanical power transmission system during the application of the force to the force receiving structure and receiving information about an angular displacement $\Delta\theta$ of a rotatable shaft to which the force receiving structure and the force generator are connected; and, determining the applied force values based on the deformation.

9. The method according to claim 1, further comprising:

receiving a trigger for signaling the computer to change the first non-circular geometry to a second non-circular geometry;

in response to the trigger, determining or retrieving second geometrical scaling values associated with the angular positions and incorporating the second geometrical scaling values into the kinetic model of the exercise apparatus to form a second modified kinetic model, the second geometrical scaling values being associated with a second non-circular gear of a second geometry and computing second resistive force values based on the second kinetic model and the applied force values; and controlling the force generator based on second resistive force values so that the exercise apparatus behaves as an exercise apparatus comprising the mechanical power transmission system including the second non-circular gear, the second resistive force values being computed using the second modified kinetic model and the applied force values.

10. The method according to claim 1, wherein the geometrical scaling values transform the exercise apparatus having a constant gear ratio for different angular positions into the exercise apparatus with a virtual non-circular gear having different gearing ratio's for different angular positions.

11. The method according to claim 1, wherein the exercise apparatus is selected from the group consisting of: a stationary exercise bicycle, a stationary rowing machine and a weight lifting machine.

12. A computer program product comprising software code portions configured for, when run in the memory of a computer, executing the computer-implemented method steps according to the method of claim 1.

13. A method of determining a geometry of a non-circular gear for a mechanical power transmission system of an exercise apparatus, the method comprising:

determining or receiving angular positions of a rotatable axle of the exercise apparatus when a force is applied to a force receiving structure of the exercise apparatus, the rotatable axle being part of the mechanical power transmission system connecting the force receiving structure via the rotatable axis to a force generator which is controlled by a computer based on a kinetic model, the kinetic model being based on equations of motion of an exercise on the exercise apparatus;

determining or retrieving first geometrical scaling values associated with the angular positions and using the first geometrical scaling values in the kinetic model to form a first modified kinetic model, the first geometrical scaling values being used for simulating a first non-circular gear of a first predetermined non-circular geometry;

determining applied force values for the angular positions, each of the applied force values representing the force that is applied to the force receiving structure; and, controlling the force generator based on first resistive force values so that the exercise apparatus behaves as an exercise apparatus comprising the mechanical power transmission system including the first non-circular gear, the first resistive force values being computed using the first modified kinetic model and the applied force values;

determining a loss value based on a cost function, the cost function depending on a physical quantity of the exercise apparatus; and, adjusting of at least part of the first non-circular geometry to define a second non-circular gear having a second non-circular geometry when the first loss value does not comply with an optimization condition; and, determining or retrieving for the second non-circular gear, second geometrical scaling values associated with the angular positions and incorporating the second geometrical scaling values into the kinetic model to form a second modified kinetic model.

14. The method according to claim 13 further comprising:

determining one or more further loss values based on one or more further adjustments of the geometry of the first non-circular gear and the associated geometrical scaling values until one of the one or more loss values complies with the optimization condition;

generating a data structure representing the geometry of the first non-circular gear that complies with the optimization condition;

storing the data structure on a storage medium;

using the data structure to control a computer-controlled manufacturing system to manufacture the non-circular gear.

15. The method according to claim 13, wherein the cost function is configured to minimize a peak force applied to the mechanical power transmission system or a peak angular velocity of a gear in the mechanical power transmission system; or, wherein the cost function is configured to minimize fluctuations in the force applied to the mechanical power transmission system or to minimize fluctuations in the angular velocity of the gear in the mechanical power transmission system.

16. A computer program product comprising software code portions configured for, when run in the memory of a computer, executing the computer-implemented method steps according to the method of claim 13.

17. A controller for an exercise apparatus comprising:

a computer readable storage medium having computer readable program code embodied therewith, and a processor coupled to the computer readable storage medium, wherein responsive to executing the computer readable program code, the processor is configured to perform executable operations comprising:

determining or receiving angular positions of a rotatable axle of the exercise apparatus when a force is applied to a force receiving structure of the exercise apparatus, the rotatable axle connecting the force receiving structure to a force generator which is controlled by a computer based on a kinetic model, the kinetic model being based on equations of motion of an exercise on the exercise apparatus;

determining or retrieving first geometrical scaling values associated with the angular positions and using the first geometrical scaling values in the kinetic model to form a first modified kinetic model, the first geometrical scaling values being used for simulating a first non-circular gear of a first predetermined non-circular geometry; and, determining applied force values for the angular positions, each applied force value representing the force that is applied to the force receiving structure; and, controlling the force generator based on first resistive force values so that the exercise apparatus behaves as the exercise apparatus comprising a mechanical power transmission system including the first non-circular gear, the first resistive force values being computed using the first modified kinetic model and the applied force values.

18. An exercise apparatus comprising:

a frame; an axle rotatable mounted to the frame;

a force receiving structure connected to the axle;

a force generator connected to the axle;

a computer system connected to the force generator; and, a computer readable storage medium having computer readable program code embodied therewith, and a processor coupled to the computer readable storage medium, wherein responsive to executing the computer readable program code, the processor is configured to perform executable operations comprising:

determining or receiving angular positions of the rotatable axle of the exercise apparatus when a force is applied to the force receiving structure of the exercise apparatus, the rotatable axle connecting the force receiving structure to the force generator which is controlled by the computer system based on a kinetic model, the kinetic model being based on equations of motion of an exercise on the exercise apparatus;

determining or retrieving first geometrical scaling values associated with the angular positions and using the first geometrical scaling values in the kinetic model to form a first modified kinetic model, the first geometrical scaling values being used for simulating a first non-circular gear of a first predetermined non-circular geometry; and determining applied force values for the angular positions, each of the applied force values representing the force that is applied to the force receiving structure; and, controlling the force generator based on first resistive force values so that the exercise apparatus behaves as an exercise apparatus comprising a mechanical power transmission system including the first non-circular gear, the first resistive force values being computed using the first modified kinetic model and the applied force values.

19. A method of controlling a force generator of an exercise apparatus, the method comprising:

determining or receiving angular positions of an axle of the exercise apparatus when a force is applied to a force receiving structure of the exercise apparatus, the axle connecting the force receiving structure to a force generator which is controlled by a computer based on a kinetic model, the kinetic model being based on equations of motion of an exercise on the exercise apparatus;

determining or receiving gearing ratio values as a function of the angular positions, the gearing ratio values being associated with a geometry of a non-circular gearing and using the gearing ratio values in the kinetic model to form a modified kinetic model, the gearing ratio values being used for simulating a non-circular gear of a predetermined non-circular geometry;

determining for each of the angular positions, an applied force value representing a force that is applied to the force receiving structure; and, providing the angular positions and the applied force values to the input of the modified kinetic model of the exercise apparatus; and controlling the force generating device based on the gearing ratio values and applied force values to generate a resistive force so that the exercise apparatus behaves as an exercise apparatus comprising a mechanical power transmission system including the non-circular geometry.

20. An exercise apparatus comprising:

a frame; an axle rotatable mounted to the frame;

at least one force receiving structure connected to a first part of the rotatable axle and a force generator connected to a second part of the rotational axle;

a position detection system configured to measure an angular position of circular gearing of a mechanical power transmission system, the angular position being generated by the position detection system in response to a user of the exercise apparatus applying a force to the force receiving structure; and a computer configured to control the force generator, the computer being configured to:

determine or receive angular positions of the rotatable axle of the exercise apparatus when the force is applied to the force receiving structure of the exercise apparatus, the rotatable axle connecting the force receiving structure to the force generator which is controlled by the computer based on a kinetic model, the kinetic model being based on equations of motion of an exercise on the exercise apparatus, gearing ratios being used for simulating a non-circular gear of a predetermined non-circular geometry;

determine or receive gearing ratio values as a function of the angular positions, the gearing ratio values being associated with a geometry of a non-circular gearing and using the gearing ratio values in the kinetic model to form a modified kinetic model;

determine for each of the angular positions, an applied force value representing the force that is applied to the force receiving structure; and provide the angular positions and the applied force values to an input of the modified kinetic model of the exercise apparatus; and control the force generating device based on the gearing ratio values and applied force values to generate a resistive force so that the exercise apparatus behaves as an exercise apparatus comprising the mechanical power transmission system including the non-circular geometry.

* * * * *